US009698480B2

(12) United States Patent
Tani et al.

(10) Patent No.: US 9,698,480 B2
(45) Date of Patent: Jul. 4, 2017

(54) SMALL ANTENNA APPARATUS OPERABLE IN MULTIPLE FREQUENCY BANDS

(71) Applicant: Panasonic Corporation, Kadoma-shi, Osaka (JP)

(72) Inventors: Kazuya Tani, Osaka (JP); Toshiharu Ishimura, Osaka (JP); Kenji Nishikawa, Hyogo (JP); Kazuya Nakano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 392 days.

(21) Appl. No.: 13/787,158

(22) Filed: Mar. 6, 2013

(65) Prior Publication Data

US 2014/0071000 A1 Mar. 13, 2014

(30) Foreign Application Priority Data

Sep. 13, 2012 (JP) ..... 2012-201477

(51) Int. Cl.
*H01Q 5/371* (2015.01)
*H01Q 5/00* (2015.01)
(Continued)

(52) U.S. Cl.
CPC ..... *H01Q 5/001* (2013.01); *H01Q 1/243* (2013.01); *H01Q 5/371* (2015.01); *H01Q 9/42* (2013.01)

(58) Field of Classification Search
CPC .. H01Q 9/04; H01Q 5/42; H01Q 1/38; H01Q 1/48; H01Q 5/371; H01Q 5/001; H01Q 9/42; H01Q 1/243
See application file for complete search history.

(56) References Cited

U.S. PATENT DOCUMENTS 4,860,019 A * 8/1989 Jiang et al. ..... 343/795
8,638,261 B2 * 1/2014 Tai et al. ..... 343/700 MS
(Continued)

FOREIGN PATENT DOCUMENTS

JP 2008-177668 7/2008
JP 2010-87752 4/2010
(Continued)

OTHER PUBLICATIONS

Office Action issued in corresponding Japanese Patent Application No. 2013-044484 on May 10, 2016.

*Primary Examiner* — Graham Smith
*Assistant Examiner* — Noel' Maldonado
(74) *Attorney, Agent, or Firm* — Hamre, Schumann, Mueller & Larson, P.C.

(57) ABSTRACT

A first base radiation element has a first end connected to the feed point, and a second end. A second base radiation element has a first end connected to the ground point, and a second end. The first and second base radiation elements respectively include portions extending in a first direction and close to each other. The first base radiation element is branched into first and second branch radiation elements at a first branch point located at the second end of the first base radiation element, the first branch radiation element includes a portion extending in the first direction, and the second branch radiation element includes a portion extending in a second direction opposite to the first direction. The end of the second base radiation element is connected to a connecting point different from the first branch point of the first branch radiation element.

19 Claims, 30 Drawing Sheets

(51) Int. Cl.
*H01Q 1/24* (2006.01)
*H01Q 9/42* (2006.01)

(56) References Cited

U.S. PATENT DOCUMENTS

| | | | | |
|---|---|---|---|---|
| 8,854,273 | B2 * | 10/2014 | Li | H01Q 5/35 343/741 |
| 2008/0169981 | A1 | 7/2008 | Hotta et al. | |
| 2009/0256763 | A1 | 10/2009 | Chi et al. | |
| 2010/0171676 | A1 | 7/2010 | Tani et al. | |
| 2010/0271271 | A1 | 10/2010 | Wu | |
| 2012/0249393 | A1 * | 10/2012 | Hotta | H01Q 1/243 343/843 |

FOREIGN PATENT DOCUMENTS

| | | | |
|---|---|---|---|
| JP | 2010-288175 | A | 12/2010 |
| WO | WO 2009/031229 | | 3/2009 |

* cited by examiner

SMALL ANTENNA APPARATUS OPERABLE IN MULTIPLE FREQUENCY BANDS

BACKGROUND

1. Technical Field

The present disclosure relates to an antenna apparatus, and more particularly, relates to a small antenna apparatus operable in multiple bands. The present disclosure also relates to a communication apparatus and an electronic device, provided with such an antenna apparatus.

2. Description of Related Art

In recent years, wireless services using wireless communication apparatuses, such as mobile phones and smartphones, have widely popularized. As these wireless services have been sophisticated, it is required to improve communication quality and communication speed. Accordingly, each country plans to adopt a new communication scheme, LTE (Long Term Evolution) or LTE-Advanced, and to widen a frequency band to be used.

A new communication system such as LTE is added to a conventional 3G Wireless Wide Area Network, which in turn increases the number of frequency bands to be supported by a single wireless communication apparatus. In general, the UHF (Ultra High Frequency) band, which is advantageous for radio wave propagation, is wanted above all. Hence, each country plans to allocate new frequency bands, e.g., 704 to 746 MHz, 746 to 787 MHz, 1427.9 to 1500.9 MHz, 2.3 to 2.4 GHz, and 2.5 to 2.69 GHz, etc.

By providing a wireless communication apparatus with an antenna apparatus supporting the above-described various frequency bands allocated and used in each country, the antenna apparatus is expected to be more usable, e.g., international roaming becomes possible. Therefore, there is an increasing demand for achieving the multiband and wide band operation of an antenna apparatus.

As prior-art antenna apparatuses aiming to achieve multiband and wide band operation, the following antenna apparatuses are known.

An antenna apparatus of PCT International Publication WO 2009/031229 A is provided with: a first conductive wire; a second conductive wire connected to and intersecting the first conductive wire; a third conductive wire parallel to the first conductive wire, and connected to and intersecting the second conductive wire; a fourth conductive wire connected to and intersecting the third conductive wire; and a first planar conductive plate connected to one or two of the first, second, third, and fourth conductive wires, and arranged in a region surrounded by three of the first, second, third, and fourth conductive wires. In addition, an edge of the first planar conductive plate is parallel to the first conductor not connected to the first planar conductive plate.

An antenna apparatus of US Patent Application Publication No. 2009/0256763 A is a multiband folded loop antenna provided with a dielectric substrate, a ground plane, a radiating portion, and a matching circuit. The ground plane is located on the dielectric substrate, and has a grounding point. The radiating portion includes a supporter, a loop strip, and a tuning patch. The loop strip has a length about half wavelength of the antenna's lowest resonant frequency. The loop strip has a feeding end and a grounding end, and the grounding end is electrically grounded to the grounding point on the ground plane. The loop strip is folded into a three-dimensional structure, and is supported by the supporter. The tuning patch is electrically connected to the loop strip. The matching circuit is located on the dielectric substrate, with one terminal electrically connected to the feeding end of the loop strip and another terminal to a signal source.

An antenna apparatus of Japanese Patent Laid-open Publication No. 2008-177668 has a feed element portion, a folded element portion, and an open-end element portion. The feed element portion is fed at a feed point on a substrate. The feed element portion is formed to extend from the feed point to a first branch point, with a width "d". The folded element portion branches from the feed element portion at the first branch point, and is folded at a folding point, and grounded at a ground end. The open-end element portion branches from the feed element portion at a second branch point, and is terminated at an open end. Both sides of the folding point on the folded element portion are short-circuited at a short circuit point between the first branch point or the ground end and the folding point.

An antenna apparatus of US Patent Application Publication No. US 2010/0271271 A is provided with a high-frequency radiator, a low-frequency radiator, a feeding connecter, and a grounding connecter. The feeding connecter electrically connects one terminal of the high-frequency radiator and the low-frequency radiator, to a feeding point. The grounding connecter electrically connects the other terminal of the high-frequency radiator and the low-frequency radiator, to a ground. The feeding connecter forms a first folded loop antenna including the high-frequency radiator and the grounding connecter, and resonating at a first frequency band. The feeding connecter forms a second folded loop antenna including the low-frequency radiator and the grounding connecter, and resonating at a second, a third, and a fourth frequency band. The first and second folded loop antennas are folded to form a three-dimensional structure.

An antenna apparatus of Japanese Patent Laid-open Publication No. 2010-087752 has a radiation electrode and a parasitic electrode. The radiation electrode is provided with a U-shaped folded strip electrode, having one end connected to a feed point and the other end as an open end, and supports a fundamental frequency band and harmonic frequency bands. The parasitic electrode is formed on the same plane as the radiation electrode, separated from the radiation electrode by a certain distance so as to be capacitively coupled to the folded portion of the radiation electrode, and connected to the ground.

SUMMARY

An antenna apparatus having a folded structure can easily obtain wide band characteristics when its entire antenna element resonates at a predetermined frequency. However, it is difficult to configure the antenna apparatus such that using any one of other adjustable frequencies, at least a part of the antenna element resonates at the frequency (multiband operation).

In the antenna apparatus having a folded structure, the antenna element has folded portions extending parallel to each other. Since there is a somewhat wide gap between these parallel portions, the antenna apparatus has an increased radiation impedance. Further, for the purpose of improved performance, reduced size, etc., the antenna element has a three-dimensional structure with a certain thickness due to a folded structure at a tip of an antenna element, as disclosed in the above-described prior art documents. Therefore, conventionally, there is a limit on reducing thickness and size of the antenna apparatus having a folded structure.

In the case of an antenna apparatus operable in an 800 MHz band, since the 800 MHz band has a relatively long wavelength, the antenna apparatus has an increased size. Therefore, conventionally, it is difficult to achieve both the operation of the antenna apparatus in multiple bands including the 800 MHz band, and the size reduction of the antenna apparatus without impairing the design of a wireless communication apparatus.

The present disclosure provides a small antenna apparatus operable in multiple and wide bands. The present disclosure also provides a communication apparatus and an electronic device, provided with such an antenna apparatus.

An antenna apparatus according to the present disclosure is provided with: a feed point; a ground point; a first base radiation element and a second base radiation element; and a first branch radiation element and a second branch radiation element. The first base radiation element has a first end connected to the feed point, and a second end. The second base radiation element has a first end connected to the ground point, and a second end. The first and second base radiation elements respectively include portions extending in a first direction and close to each other. The first base radiation element is branched into the first and second branch radiation elements at a first branch point located at the second end of the first base radiation element, the first branch radiation element includes a portion extending in the first direction, and the second branch radiation element includes a portion extending in a second direction opposite to the first direction. The second end of the second base radiation element is connected to a connecting point different from the first branch point of the first branch radiation element.

The antenna apparatus according to the present disclosure can operate in multiple and wide bands, while having a small size.

DETAILED DESCRIPTION

Figure 1:
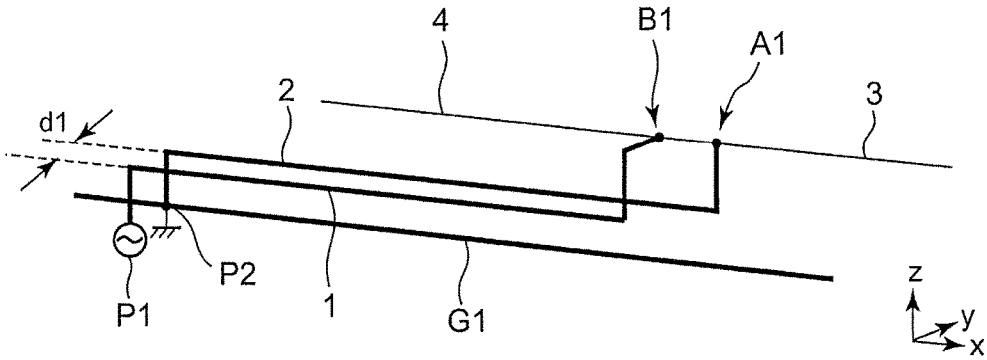
FIG. 1 is a perspective view showing an outline of an antenna apparatus according to a first embodiment.

Embodiments will be described in detail below, appropriately referring to the drawings. It is noted that an unnecessarily detailed description may be omitted. For example, detailed descriptions of well-known matters or an redundant descriptions of substantially the same configurations may be omitted. This is to avoid the following description from being unnecessarily redundant, and to facilitate ease of understanding by those skilled in the art.

It is noted that the inventors provide the following description and the accompanying drawings, not to limit the claimed subject matters, but to facilitate for those skilled in the art to sufficiently understand the present disclosure.

First Embodiment

1. Basic Configuration of First Embodiment

1-1. Outlines of Antenna Apparatuses with Basic Configuration

First of all, with reference to FIGS. 1 to 3, antenna apparatuses with basic configuration will be described.

[1-1-1. Antenna Apparatus with Basic Configuration (1)]

FIG. 1 is a perspective view showing an outline of an antenna apparatus according to a first embodiment. The antenna apparatus of FIG. 1 is provided with a feed point P1, a ground point P2, first and second base radiation elements 1 and 2, and first and second branch radiation elements 3 and 4. In FIG. 1, etc., the base radiation elements 1 and 2 (and a ground conductor G1 which will be described later) are shown by thick lines, and the branch radiation elements 3 and 4 (and a branch radiation element 5 which will be described later) are shown by thin lines. The base radiation element 1 has a first end connected to the feed point P1, and a second end. The base radiation element 2 has a first end connected to the ground point P2, and a second end. The base radiation elements 1 and 2 respectively include portions extending in a first direction and close to each other. In the example of FIG. 1, the base radiation elements 1 and 2 respectively include portions extending in the "+x" direction, and close to each other at a distance "d1" in the "y" direction. In these portions, the base radiation elements 1 and 2 are parallel to each other. The base radiation element 1 is branched into the first and second branch radiation elements 3 and 4 at a first branch point B1 located at the second end of the base radiation element 1. The branch radiation element 3 includes a portion extending in the first direction (in FIG. 1, the "+x" direction). The branch radiation element 4 includes a portion extending in a second direction (in FIG. 1, the "−x" direction) opposite to the first direction. The second end of the base radiation element 2 is connected to a connecting point A1 different from the branch point B1 of the branch radiation element 3. When the antenna apparatus operates at a first frequency (hereinafter, referred to as a "low-band frequency") F1, the base radiation elements 1 and 2 and the branch radiation element 3 resonate. When the antenna apparatus operates at a second frequency (hereinafter, referred to as a "mid-band frequency") F2 higher than the first frequency F1, the branch radiation element 4 resonates.

As will be described later with reference to FIGS. 30 to 34, the antenna apparatus of FIG. 1 may be configured as conductive patterns formed on both sides of a dielectric substrate (a printed circuit board or flexible circuit board). In this case, the distance "d1" between the base radiation elements 1 and 2 at the portions where the base radiation elements 1 and 2 are close to each other is, for example, equal to the thickness of the dielectric substrate, i.e., about 0.5 mm to several mm. The dielectric substrate is made of material having a certain dielectric constant, including resin material such as FR4 or ABS, Teflon (registered trademark), glass epoxy resin, etc. The base radiation elements 1 and 2 and the branch radiation elements 3 and 4 are made of conductor material having high conductivity, and can be configured by forming as conductive patterns on the dielectric substrate, or alternatively, for example, plating on the dielectric substrate, attaching adhesive sheets to the dielectric substrate, winding flexible cables around the dielectric substrate, etc. The base radiation elements 1 and 2 and the branch radiation elements 3 and 4 may be configured by working conductor material as sheet metal. It is possible to configure a thin, integrated antenna apparatus by forming the base radiation elements 1 and 2 and the branch radiation elements 3 and 4 on both sides of the dielectric substrate, and connecting both sides of the dielectric substrate by a through-hole conductor. There is an advantageous effect that the size and thickness of the antenna apparatus can be reduced by configuring the antenna apparatus as the conductive patterns formed on the dielectric substrate.

The feed point P1 is connected to a wireless communication circuit (not shown) through, for example, a common high-frequency feed line having a characteristic impedance of 50Ω, such as a coaxial cable or a microstrip line (not shown).

The antenna apparatus of FIG. 1 is further provided with a ground conductor G1. The ground point P2 is connected to the ground conductor G1, and has the same voltage potential as that of the ground conductor G1. The ground conductor G1 is a conductor, such as a housing of a wireless communication apparatus in which the antenna apparatus is installed, a ground conductor of a circuit board of the wireless communication apparatus, a shield conductor of the wireless communication apparatus, and metal parts included in a device such as a liquid crystal display. Although the linear ground conductor G1 of FIG. 1 is shown for ease of illustration, the ground conductor G1 may be planar, curved, or shaped in any other form. The ground point P2 is electrically and mechanically connected to the ground conductor G1, using, for example, a screw, a spring contact, a tape of an aluminum or copper conductive sheet, or a high-frequency conductive structure such as a capacitive coupling. The base radiation elements 1 and 2 the branch radiation elements 3 and 4 are arranged, for example, substantially parallel to the ground conductor G1 at a certain distance from the ground conductor G1.

The antenna apparatus of FIG. 1 has a folded antenna structure in which the end of the base radiation element 2 is connected to the connecting point A1 on the branch radiation element 3, and accordingly, the base radiation elements 1 and 2 including parallel portions are short-circuited at their respective one ends by the branch radiation element 3. In the example shown in FIG. 1, the base radiation element 1 proceeds from the feed point P1 in the "+x" direction, and is bent in the "+z" direction, and then proceeds in the "+z" direction over a certain length, and is bent in the "+y" direction, and then proceeds in the "+y" direction over the distance "d1", and arrives at the branch point B1. The base radiation element 2 proceeds in the "+x" direction, and is bent in the "+z" direction, and then proceeds in the "+z" direction over a certain length, and arrives at the connecting point A1. In the example shown in FIG. 1, the base radiation elements 1 and 2 are bent at right angles to configure the antenna apparatus as a folded antenna. However, the base radiation elements 1 and 2 may be bent at other angles, or may be curved. By configuring the antenna apparatus as a folded antenna, it is possible to achieve wide band operation when the base radiation elements 1 and 2 and the branch radiation element 3 resonate, mainly in a band including the low-band frequency F1 (e.g., 800 MHz band). It is possible to adjust the radiation impedance of the antenna apparatus mainly in the band including the low-band frequency F1, by adjusting the distance "d1" between the base radiation elements 1 and 2 at the portions where the base radiation elements 1 and 2 are close to each other, the width of the base radiation elements 1 and 2, and the length or area of the portions where the base radiation elements 1 and 2 are close to each other.

As described above, the antenna apparatus of FIG. 1 can achieve multiband operation in bands including the frequencies F1 and F2, and achieve wide band operation in a band including the low-band frequency F1, while having a small size.

[1-1-2. Antenna Apparatus with Basic Configuration (2)]

Figure 2:
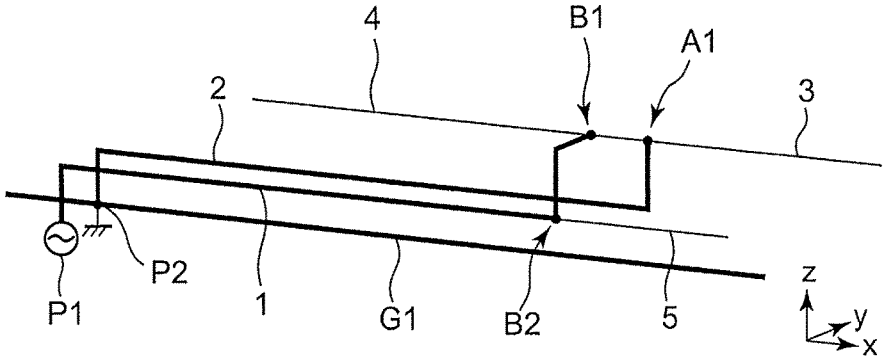
FIG. 2 is a perspective view showing an outline of an antenna apparatus according to a first modified embodiment of the first embodiment.

FIG. 2 is a perspective view showing an outline of an antenna apparatus according to a first modified embodiment of the first embodiment. The antenna apparatus of FIG. 2 is configured in a manner similar to that of the antenna apparatus of FIG. 1, and further provided with a third branch radiation element 5 branched at a second branch point B2 on a base radiation element 1. The branch radiation element 5 includes a portion extending in the first direction. When the antenna apparatus operates at a third frequency (hereinafter, referred to as a "high-band frequency") F3 higher than the second frequency F2, the branch radiation element 5 resonates.

The branch radiation element 5 is made of conductor material having high conductivity, like other base radiation elements 1 and 2 and branch radiation elements 3 and 4, and can be configured by, for example, forming as a conductive pattern on a dielectric substrate, or using other methods.

The branch radiation element 5 is arranged, for example, substantially parallel to a ground conductor G1 at a certain distance from the ground conductor G1.

As described above, the antenna apparatus of FIG. 2 can achieve multiband operation in bands including the frequencies F1, F2, and F3, and achieve wide band operation in a band including the low-band frequency F1, while having a small size.

[1-1-3. Antenna Apparatus with Basic Configuration (3)]

Figure 3:
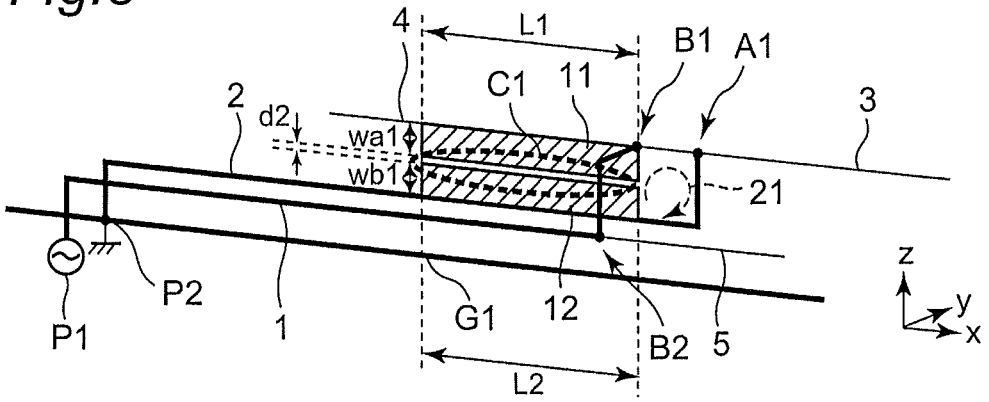
FIG. 3 is a perspective view showing an outline of an antenna apparatus according to a second modified embodiment of the first embodiment.

FIG. 3 is a perspective view showing an outline of an antenna apparatus according to a second modified embodiment of the first embodiment. The antenna apparatus of FIG. 3 is configured in a manner similar to that of the antenna apparatus of FIG. 2, and further provided with a first coupling element 11 integrally formed with a branch radiation element 4, and a second coupling element 12 integrally formed with a base radiation element 2. Due to such a configuration, a capacitive coupling C1 occurs between the coupling elements 11 and 12.

Referring to FIG. 3, the coupling element 11 has a length "L1" in the "x" direction, and a width "wa1" in the "z" direction, and is provided in the "−z" direction relative to the branch radiation element 4. The coupling element 12 has a length "L2" in the "x" direction, and a width "wb1" in the "z" direction, and is provided in the "+z" direction relative to the base radiation element 2. A "−z" side of the coupling element 11 is close to a "+z" side of the coupling element 12 at a distance "d2" (e.g., 0.1 mm to 0.5 mm), and thus, the coupling elements 11 and 12 are capacitively coupled to each other. Since the coupling elements 11 and 12 are capacitively coupled to each other, the branch radiation element 4 and the base radiation element 2 are capacitively coupled to each other. It is noted that when the branch radiation element 4 resonates at the mid-band frequency F2, a current is concentrated at a position of the branch radiation element 4 close to a branch point B1, and on the other hand, a magnetic field dominate over an electric field at an end of the branch radiation element 4 remote from the branch point B1. Therefore, in order that the branch radiation element 4 and the base radiation element 2 are capacitively coupled to each other not at the end of the branch radiation element 4 remote from the branch point B1, but at a position of the branch radiation element 4 close to the branch point B1, the coupling element 11 is provided at the position of the branch radiation element 4 close to the branch point B1, avoiding the end of the branch radiation element 4 remote from the branch point B1. It is possible to adjust the radiation impedance of the antenna apparatus mainly at the mid-band frequency F2 and the high-band frequency F3, by adjusting the dimensions of the coupling elements 11 and 12 ("L1", "L2", "wa1", and "wb1").

In addition, in the antenna apparatus of FIG. 3, a micro loop 21 is formed of a portion of the base radiation element 2 close to a connecting point A1, a portion of a branch radiation element 3 between the branch point B1 and the connecting point A1, and "+x" sides of the coupling elements 11 and 12.

1-2. Specific Implementations of Antenna Apparatuses with Basic Configuration Next, with reference to FIGS. 4 to 6, specific implementations of antenna apparatuses with basic configuration will be described.

[1-2-1. Antenna Apparatus of First Implementation Example]

Figure 4:
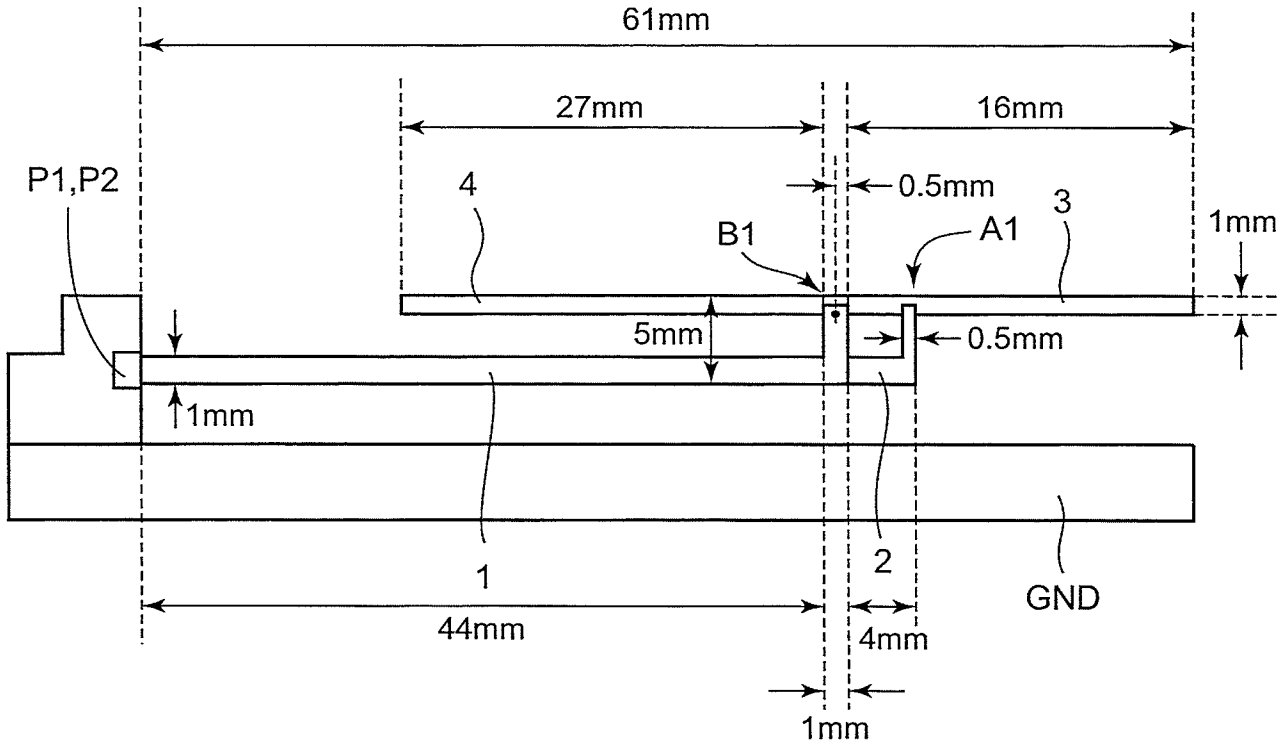
FIG. 4 is a diagram showing a configuration of an antenna apparatus according to a first implementation example of the first embodiment.

FIG. 4 is a diagram showing a configuration of an antenna apparatus according to a first implementation example of the first embodiment. The antenna apparatus of FIG. 4 shows an example of a specific implementation of the antenna apparatus of FIG. 1 (the antenna apparatus with basic configuration (1)). In the first implementation example, the distance "d1" between base radiation elements 1 and 2 is 0.8 mm.

[1-2-2. Antenna Apparatus of Second Implementation Example]

Figure 5:
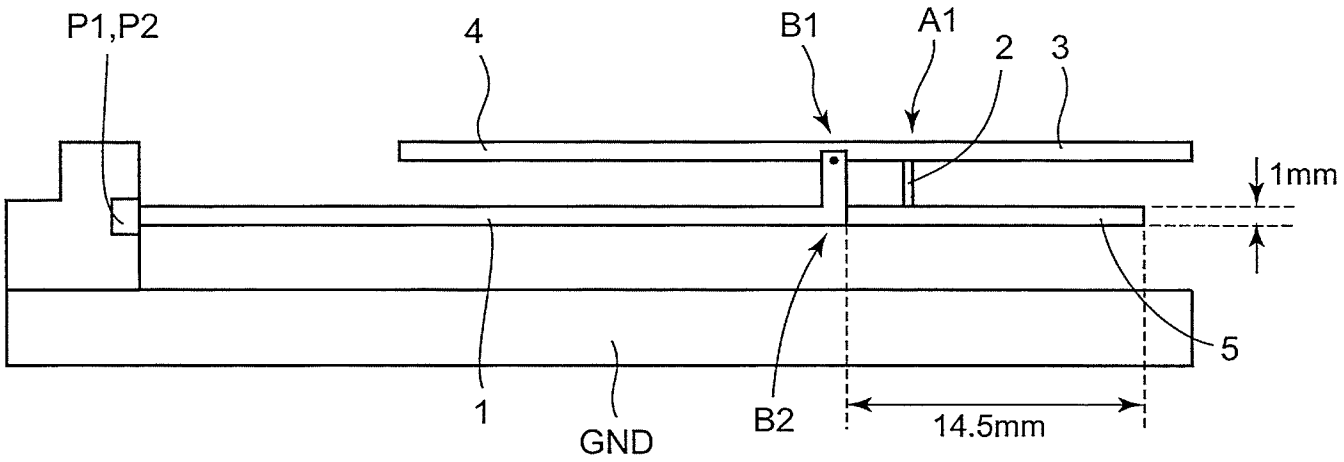
FIG. 5 is a diagram showing a configuration of an antenna apparatus according to a second implementation example of the first embodiment.

FIG. 5 is a diagram showing a configuration of an antenna apparatus according to a second implementation example of the first embodiment. The antenna apparatus of FIG. 5 shows an example of a specific implementation of the antenna apparatus of FIG. 2 (the antenna apparatus with basic configuration (2)). The antenna apparatus of the second implementation example is different from the first implementation example, in that a branch radiation element 5 is added. The length of the branch radiation element 5 is 14.5 mm.

[1-2-3. Antenna Apparatus of Third Implementation Example]

Figure 6:
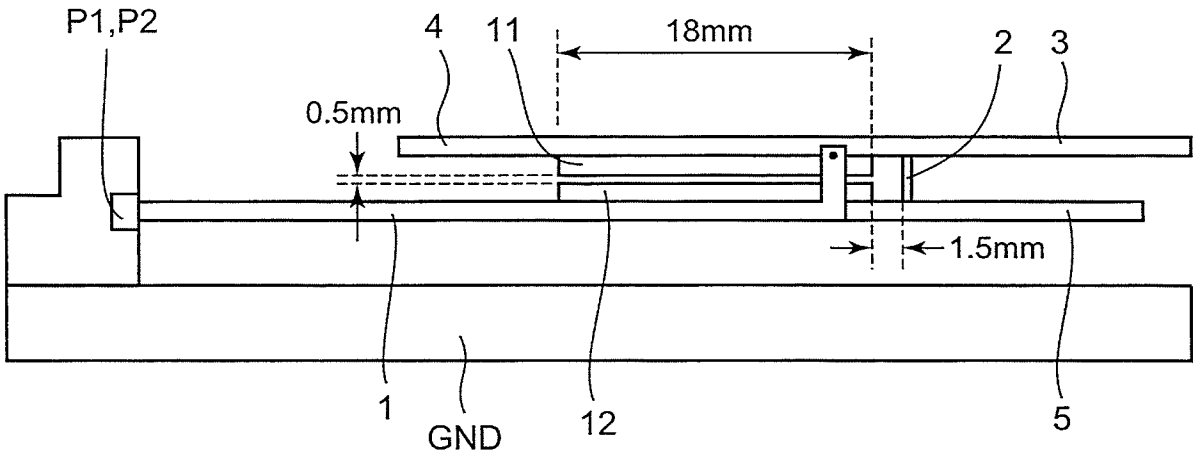
FIG. 6 is a diagram showing a configuration of an antenna apparatus according to a third implementation example of the first embodiment.

FIG. 6 is a diagram showing a configuration of an antenna apparatus according to a third implementation example of the first embodiment. The antenna apparatus of FIG. 6 shows an example of a specific implementation of the antenna apparatus of FIG. 3 (the antenna apparatus with basic configuration (3)). The antenna apparatus of the third implementation example is different from the second implementation example, in that coupling elements 11 and 12 are added. The coupling elements 11 and 12 are close to each other at a distance "d2" of 0.5 mm, and thus, the coupling elements 11 and 12 are capacitively coupled to each other.

[1-2-4. Antenna Apparatus of Fourth Implementation Example]

Figure 12:
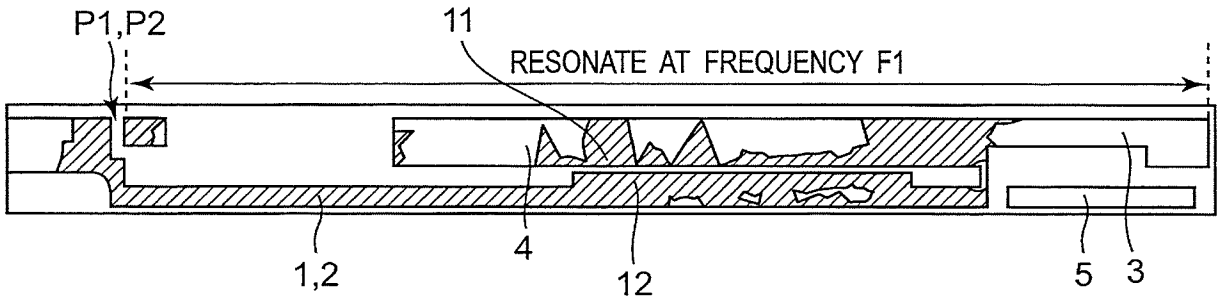
FIG. 12 is a diagram showing a current distribution observed when an antenna apparatus according to a fourth implementation example of the first embodiment operates at a low-band frequency F1 (960 MHz)
Figure 13:
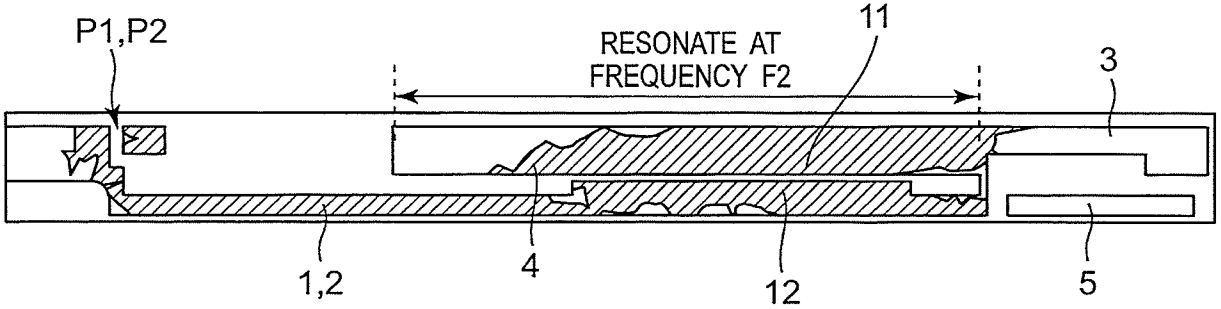
FIG. 13 is a diagram showing a current distribution observed when the antenna apparatus according to the fourth implementation example of the first embodiment operates at a mid-band frequency F2 (1710 MHz)
Figure 14:
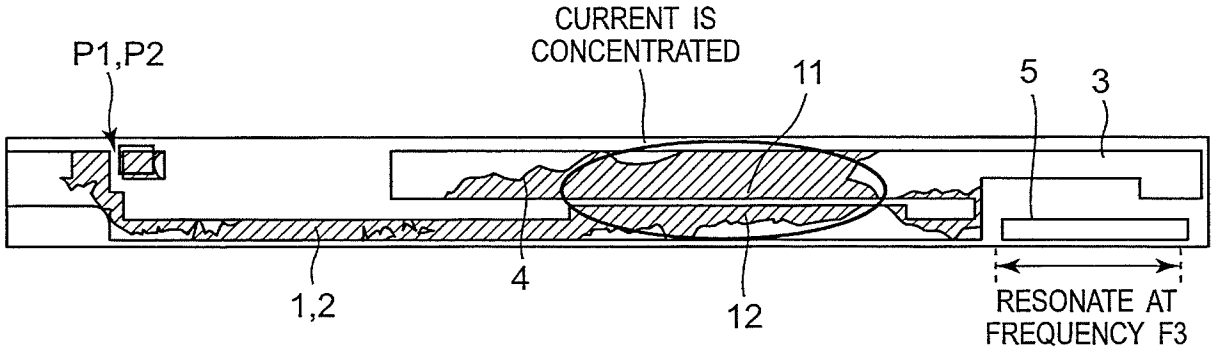
FIG. 14 is a diagram showing a current distribution observed when the antenna apparatus according to the fourth implementation example of the first embodiment operates at a first high-band frequency F3 (2170 MHz)

In addition, the antenna apparatuses of FIGS. 1 to 3 may be configured as conductive patterns formed on both sides of a dielectric substrate (a printed circuit board or flexible circuit board). An antenna apparatus of FIGS. 12 to 14 is of an exemplary case in which the antenna apparatus of FIG. 3 is configured as conductive patterns formed on both sides of a dielectric substrate.

1-3. Specific Implementations of Comparison Examples

[1-3-1. Antenna Apparatuses of First and Second Comparison Examples]

Figure 7:
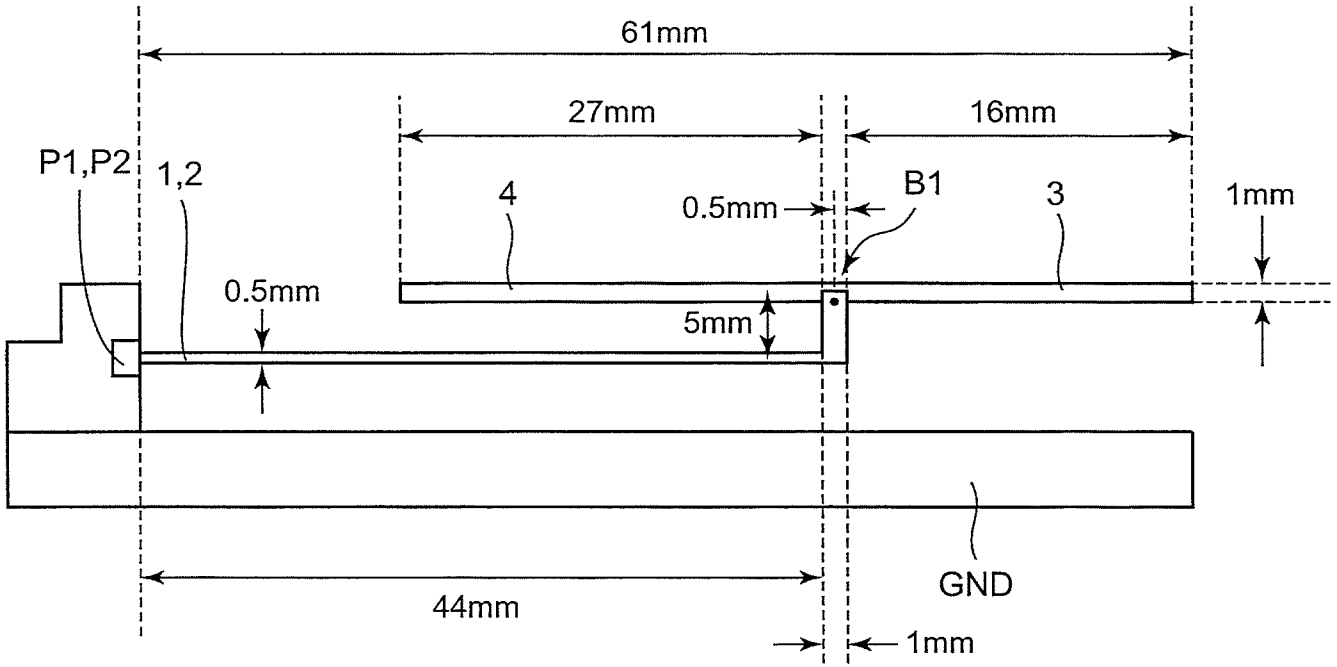
FIG. 7 is a diagram showing an outline of antenna apparatuses according to first and second comparison examples.

FIG. 7 is a diagram showing a configuration of antenna apparatuses according to first and second comparison examples. The antenna apparatuses according to the first and second comparison examples show the case in which a branch point B1 and a connecting point A1 of the antenna apparatus of FIG. 1 are located at substantially the same position. In a first comparison example, the distance "d1" between base radiation elements 1 and 2 is 4 mm. In a second comparison example, the distance "d1" between base radiation elements 1 and 2 is 0.8 mm.

[1-3-2. Antenna Apparatus of Third Comparison Example]

Figure 8:
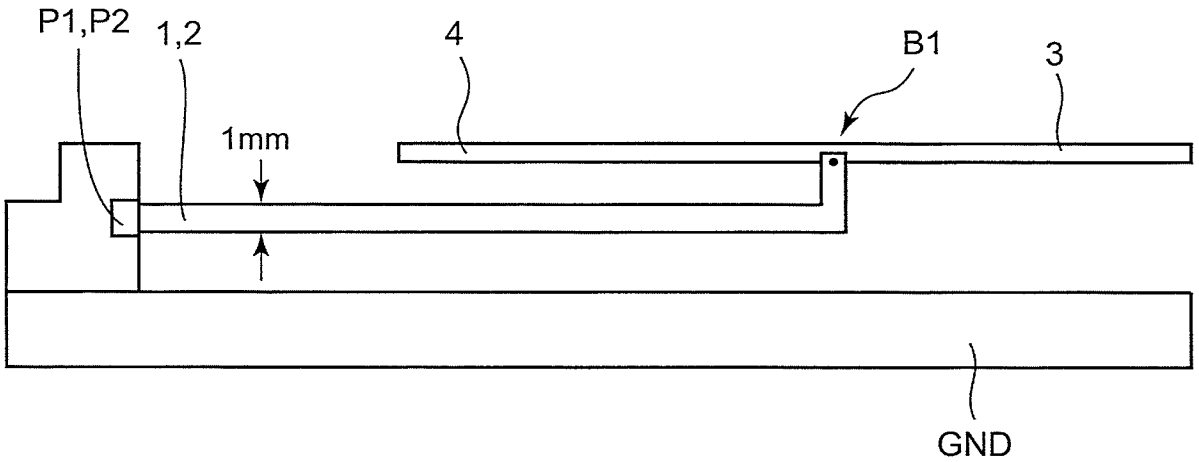
FIG. 8 is a diagram showing an outline of an antenna apparatus according to a third comparison example.

FIG. 8 is a diagram showing a configuration of an antenna apparatus according to a third comparison example. The antenna apparatus according to the third comparison example is different from the second comparison example, in that the width of each base radiation elements 1 and 2 is increased.

1-4. Advantageous Effects of Antenna Apparatuses with Basic Configuration

Figure 9:
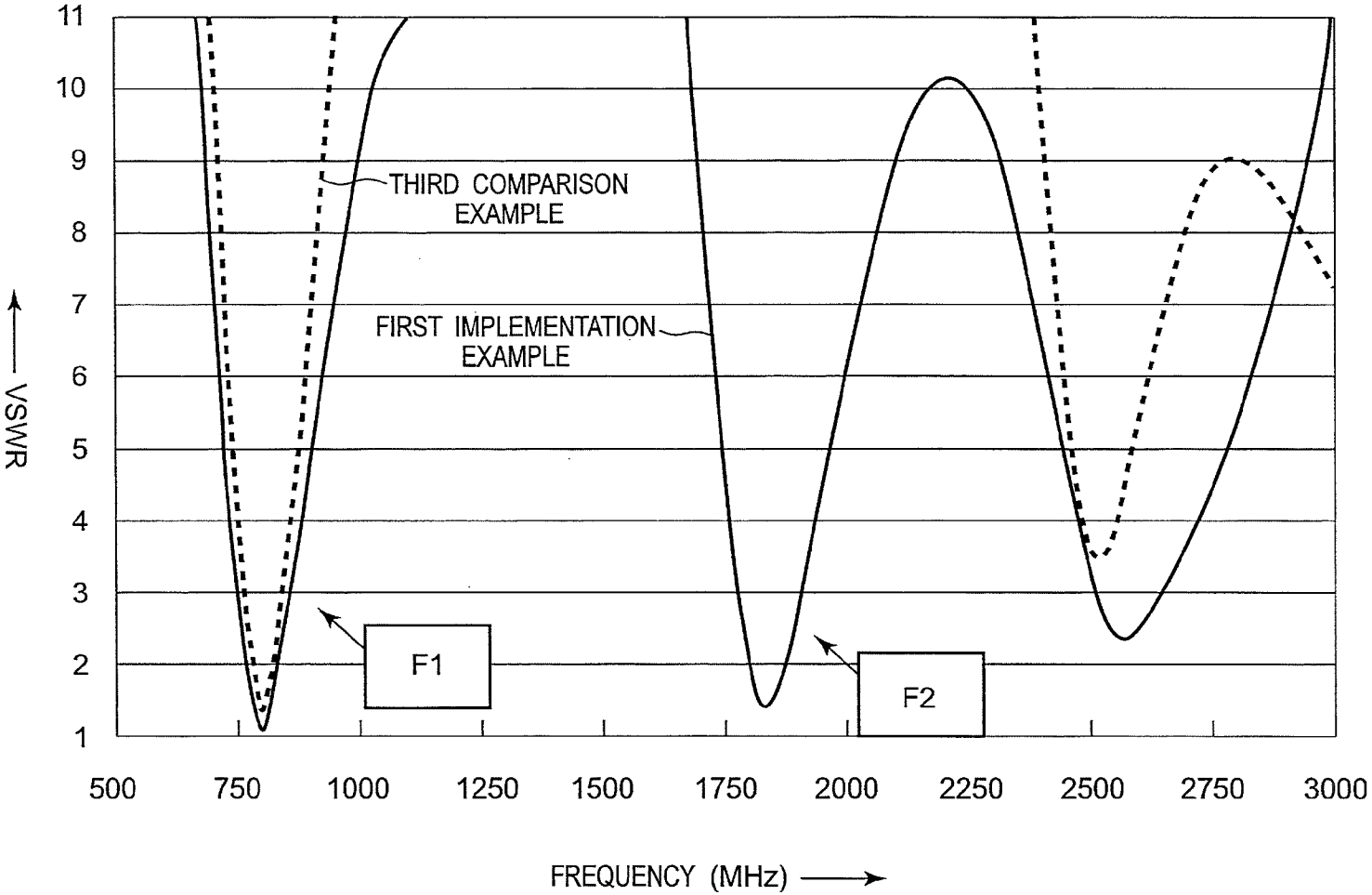
FIG. 9 is a graph showing the VSWR versus frequency characteristics of the antenna apparatuses according to the first implementation example and the third comparison example.
Figure 10:
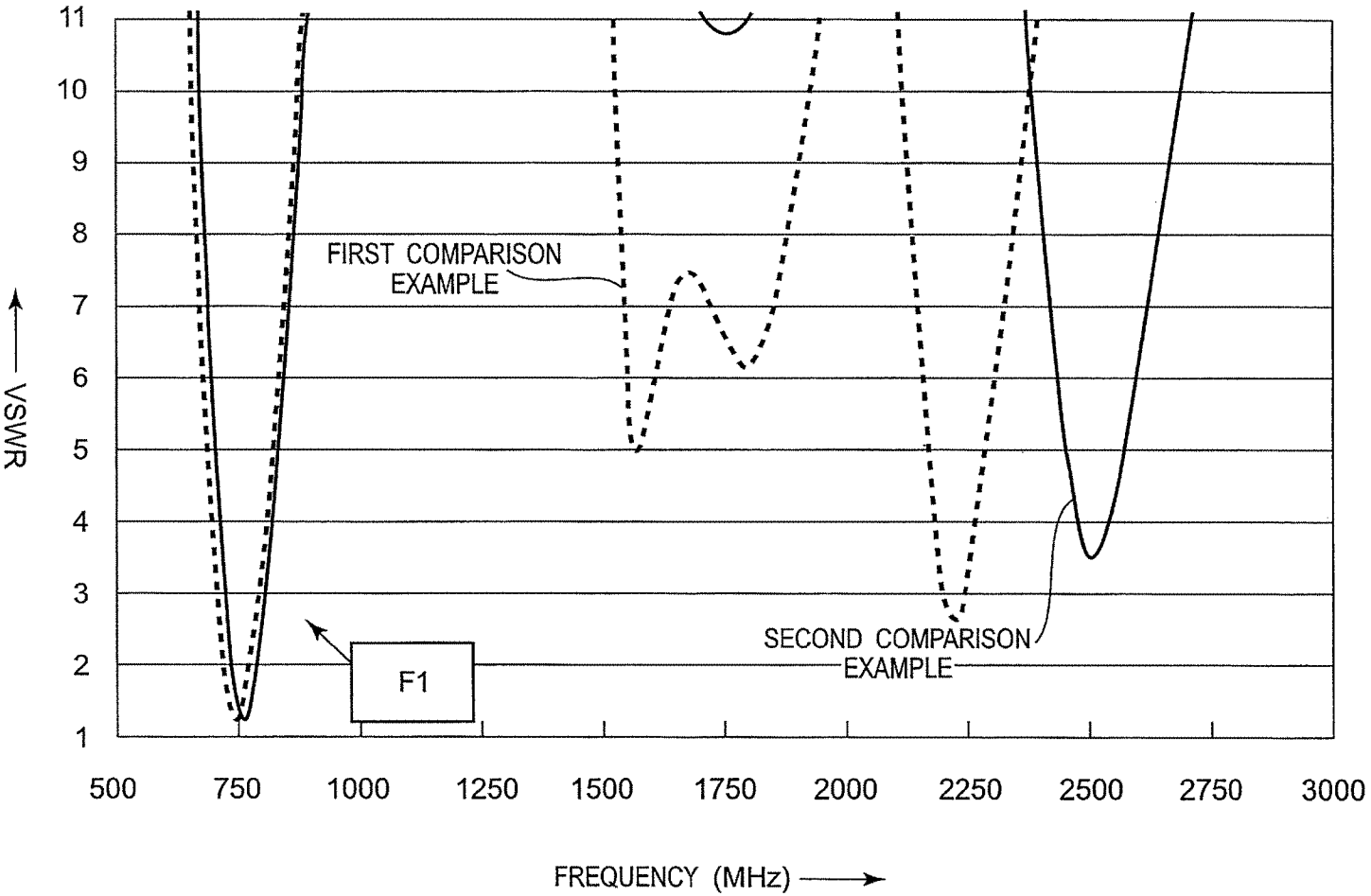
FIG. 10 is a graph showing the VSWR versus frequency characteristics of the antenna apparatuses according to the first and second comparison examples.
Figure 11:
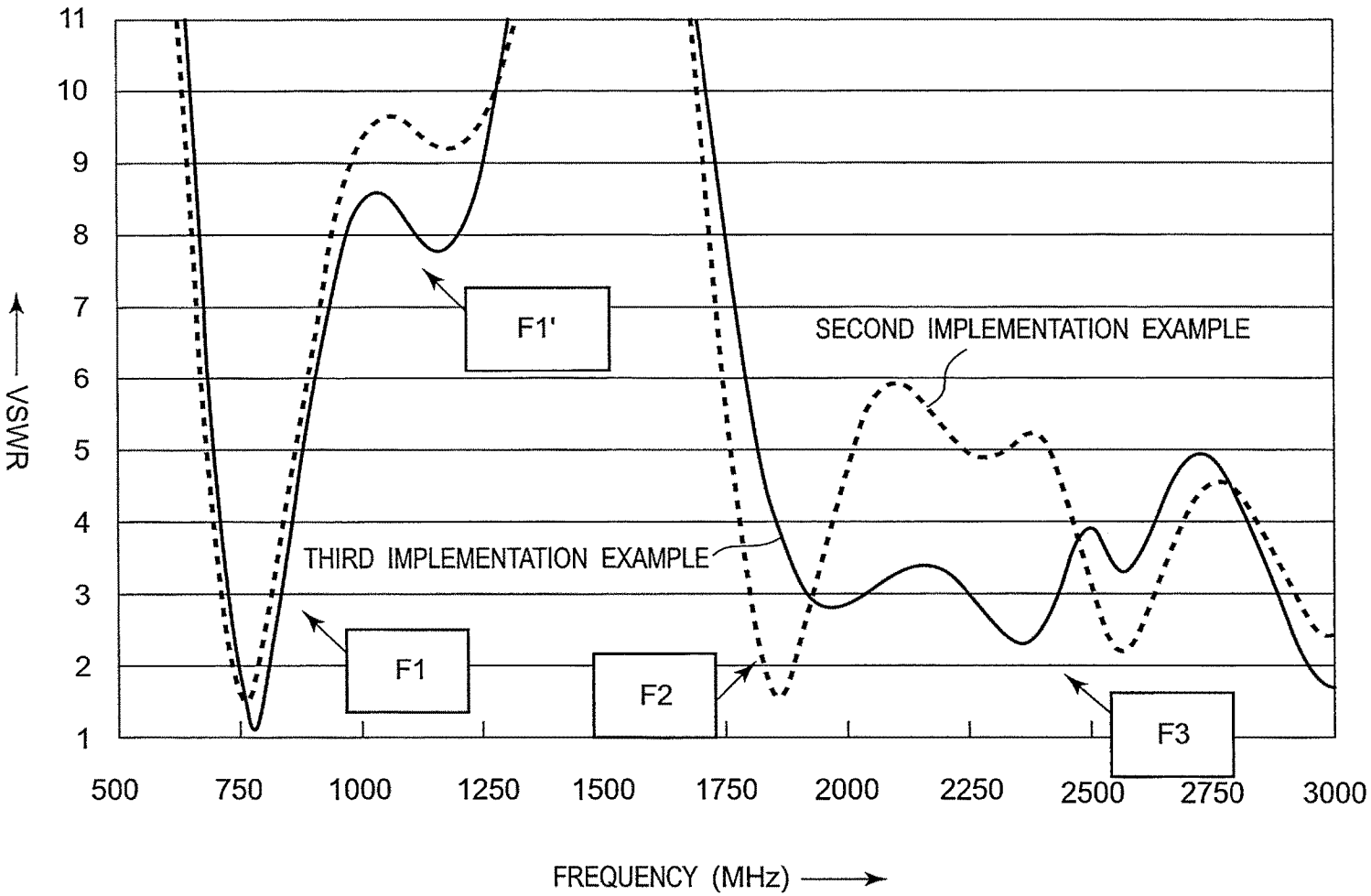
FIG. 11 is a graph showing the VSWR versus frequency characteristics of the antenna apparatuses according to the second and third implementation examples.

With reference to FIGS. 9 to 11, the advantageous effects of the antenna apparatuses with basic configuration will be described below (i.e., advantageous effects of providing the branch point B1 and the connecting point A1 at different positions, providing the branch radiation element 5, and using the capacitive coupling C1 between the coupling elements 11 and 12).

[1-4-1. Characteristics of Antenna Apparatus of First Implementation Example]

FIG. 9 is a graph showing the VSWR versus frequency characteristics of the antenna apparatuses according to the first implementation example and the third comparison example. Since the antenna apparatus according to the first implementation example is provided with the branch point B1 and the connecting point A1 at different positions, the antenna apparatus resonates at both the low-band frequency F1=800 MHz and the mid-band frequency F2=1770 MHz. The reason why the antenna apparatus of the first implementation example resonates at the mid-band frequency F2 is that since the branch point B1 and the connecting point A1 are located at different positions, the capacitive coupling value between the base radiation elements 1 and 2 changes as compared to the antenna apparatus of the third comparison example. The antenna apparatus of the first implementation example has improved resonance characteristics of the mid-band frequency F2, since a portion of the branch radiation element 3 between the branch point B1 and the connecting point A1 (i.e., the tips of the base radiation elements 1 and 2) contributes to radiation as a part of a folded antenna.

[1-4-2. Characteristics of Antenna Apparatuses of First and Second Comparison Examples]

FIG. 10 is a graph showing the VSWR versus frequency characteristics of the antenna apparatuses according to the first and second comparison examples. The antenna apparatuses according to the first and second comparison examples resonate at the low-band frequency F1=750 MHz. However, at other frequencies, only harmonic resonances are observed. Accordingly, these antenna apparatuses cannot operate in multiple bands. It is noted that when these antenna apparatuses resonate at the low-band frequency F1, a strong coupling between the elements occurs, and thus, these antenna apparatuses operate in a narrow band.

[1-4-3. Characteristics of Antenna Apparatuses of Second and Third Implementation Examples]

FIG. 11 is a graph showing the VSWR versus frequency characteristics of the antenna apparatuses according to the second and third implementation examples. Since the antenna apparatus according to the second implementation example is provided with the branch radiation element 5, the antenna apparatus resonates at the high-band frequency F3=2600 MHz, in addition to the low-band frequency F1 and the mid-band frequency F2. Since the antenna apparatus according to the third implementation example is provided with the coupling elements 11 and 12, the radiation impedances of the mid-band frequency F2 and the high-band frequency F3 are adjusted, and thus, the antenna apparatus can achieve wide band operation in bands including the mid-band frequency F2 and the high-band frequency F3. In addition, since the antenna apparatus according to the third implementation example uses the capacitive coupling C1 between the coupling elements 11 and 12, the Q-factor of the antenna apparatus decreases at the low-band frequency F1, and thus, the antenna apparatus can achieve wide band operation at the low-band frequency F1, and at another low-band frequency F1' close to the low-band frequency F1.

According to the antenna apparatus of FIG. 3, the antenna apparatus can achieve both multiband operation and wide band operation in bands including the frequencies F1, F2, and F3, by adjusting the capacitive coupling C1 between the coupling elements 11 and 12.

[1-4-4. Characteristics of Antenna Apparatus of Fourth Implementation Example]

FIG. 12 is a diagram showing a current distribution observed when the antenna apparatus according to the fourth implementation example of the first embodiment operates at the low-band frequency F1 (960 MHz). FIG. 13 is a diagram showing a current distribution observed when the antenna apparatus according to the fourth implementation example of the first embodiment operates at the mid-band frequency F2 (1710 MHz). FIG. 14 is a diagram showing a current distribution observed when the antenna apparatus according to the fourth implementation example of the first embodiment operates at a first high-band frequency F3 (2170 MHz). In FIGS. 12 to 14, crosshatched areas on radiation elements indicate portions where strong currents flow, and white areas on radiation elements indicate portions where weak currents flow.

As shown in FIG. 12, when the antenna apparatus operates at the low-band frequency F1, base radiation elements 1 and 2 and a branch radiation element 3 resonate. The total length of a folded antenna including the base radiation elements 1 and 2 and the branch radiation element 3 depends on the length of the branch radiation element 3. As a result of configuring the antenna apparatus as the folded antenna, when the antenna apparatus operates at the low-band frequency F1, currents are concentrated near a feed point P1 and a ground point P2, and concentrated near a branch point B1 and a connection point A1, on the base radiation elements 1 and 2. Accordingly, the antenna apparatus has a high radiation impedance, and thus, can achieve wide band operation in a band including the low-band frequency F1 (700 to 900 MHz).

As shown in FIG. 13, when the antenna apparatus operates at the mid-band frequency F2, a branch radiation element 4 resonates. A current is concentrated at the branch point B1. The branch radiation element 4 has a certain electrical length mainly dependent on the length and width of its portion extending in the "−x" direction from a branch point B1, and resonates at a certain mid-band frequency F2 according to the electrical length.

As shown in FIG. 14, when the antenna apparatus operates at the high-band frequency F3, a branch radiation element 5 resonates. The branch radiation element 5 is adjacent to a micro loop 21 as shown in FIG. 3. It is noted that although the branch radiation element 5 is connected to a base radiation element 1, the connecting portion is omitted in FIGS. 12 to 14. When the antenna apparatus operates at the high-band frequency F3, a current is concentrated at the capacitive coupling C1 between the coupling elements 11 and 12, and at the micro loop 21, thus adjusting the matching of the branch radiation element 5 adjacent to the micro loop 21. The branch radiation element 5 has a certain electrical length mainly dependent on its length, and resonates at a certain high-band frequency F3 according to the electrical length. It is possible to adjust the operation of the antenna apparatus at the high-band frequency F3, by adjusting the length of the branch radiation element 5.

As shown in FIGS. 12 to 14, the coupling elements 11 and 12 have a length over a part (e.g., about ⅔) of the entire length of the branch radiation element 4 from the branch point B1. As described above, a current is concentrated at a position of the branch radiation element 4 close to the branch point B1, and on the other hand, a magnetic field dominate over an electric field at an end of the branch radiation element 4 remote from the branch point B1.

1-5. Additional Remarks of the Antenna Apparatuses with Basic Configuration

As described above, the antenna apparatuses with basic configuration according to the first embodiment can achieve multiband operation, while having a small size. In addition, the antenna apparatuses with basic configuration according to the first embodiment can achieve wide band operation by using the capacitive coupling C1 between the coupling elements 11 and 12.

The connecting point A1 may be located at any position, as long as the position is different from that of the branch point B1 of the branch radiation element 3, and thus, may be located, for example, an end of the branch radiation element 3 remote from the branch point B1. In other words, a portion of the branch radiation element 3 extending in the "+x" direction from the connecting point A1 may be removed.

The coupling elements 11 and 12 are not limited to being arranged such that their respective one sides oppose to each other, and may be arranged in any manner as long as the coupling elements 11 and 12 are capacitively coupled to each other. In addition, the coupling elements 11 and 12 are not limited to be rectangular, and may be shaped in any manner as long as the coupling elements 11 and 12 are capacitively coupled to each other. In addition, the positions of the ends of the coupling elements 11 and 12 in the "+x" direction do not need to be identical to the position of the branch point B1.

In addition, when there is only small high-frequency loss in the ground conductor G1 (e.g., a housing of a wireless communication apparatus in which the antenna apparatus is installed), it is possible to adjust radiation impedance by reducing the distance between the ground conductor G1, and at least a part of the base radiation elements 1 and 2 and the branch radiation elements 3, 4, and 5.

Although the base radiation elements 1 and 2, the branch radiation elements 3, 4, and 5, and the like, of the above described antenna apparatuses of FIG. 1, etc. are shown as linear elements, their shapes are not limited thereto, and at least a part or all of them may be curved.

2-1. Outlines of Antenna Apparatuses with Additional Capacitive Couplings

Next, with reference to FIGS. 15 to 18, modified embodiments in which an antenna apparatus is provided with additional capacitive couplings will be described. In the modified embodiments, base radiation elements 1 and 2 are provided with additional capacitive couplings.

[2-1-1. Antenna Apparatus with Additional Capacitive Couplings (1)]

Figure 15:
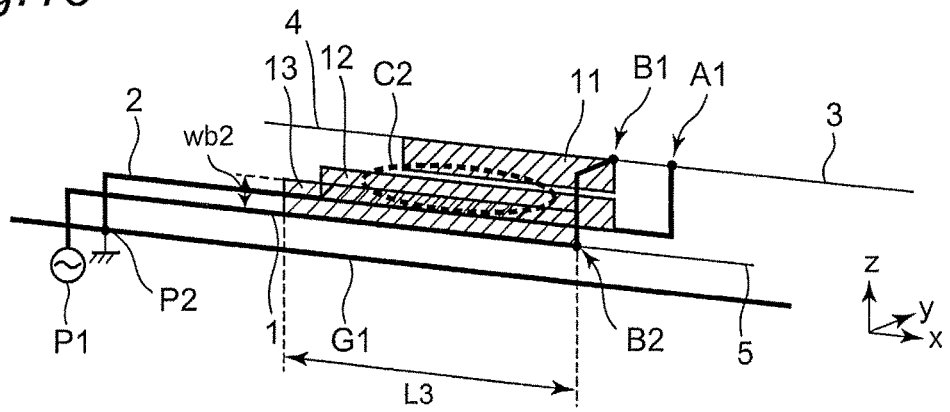
FIG. 15 is a perspective view showing an outline of an antenna apparatus according to a third modified embodiment of the first embodiment.

FIG. 15 is a perspective view showing an outline of an antenna apparatus according to a third modified embodiment of the first embodiment. The antenna apparatus of FIG. 15 is configured in a manner similar to that of the antenna apparatus of FIG. 3, and further provided with a third coupling element 13 integrally formed with a base radiation element 1. A capacitive coupling C2 occurs between the coupling element 13 and at least one of coupling elements 11 and 12. Referring to FIG. 15, the coupling element 13 has a length "L3" in the "x" direction, and a width "wb2" in the "z" direction, and is provided in the "+z" direction relative to the base radiation element 1. The coupling elements 12 and 13 are close to each other at a distance "d1", and thus, the coupling elements 12 and 13 are capacitively coupled to each other. The coupling elements 11 and 13 may be capacitively coupled to each other, in addition to the capacitive coupling between the coupling elements 12 and 13. Alternatively, only the coupling elements 11 and 13 may be capacitively coupled to each other. As described above with reference to FIG. 3, the coupling element 11 is provided at a position of a branch radiation element 4 close to a branch point B1, avoiding an end of the branch radiation element 4 remote from the branch point B1. Accordingly, the coupling element 12 is provided near the coupling element 11 in the "x" direction, and the coupling element 13 is also provided near the coupling elements 11 and 12 in the "x" direction.

Therefore, an end of the coupling element 13 in the "+x" direction is provided, for example, close to a branch point B2.

[2-1-2. Antenna Apparatus with Additional Capacitive Couplings (2)]

Figure 16:
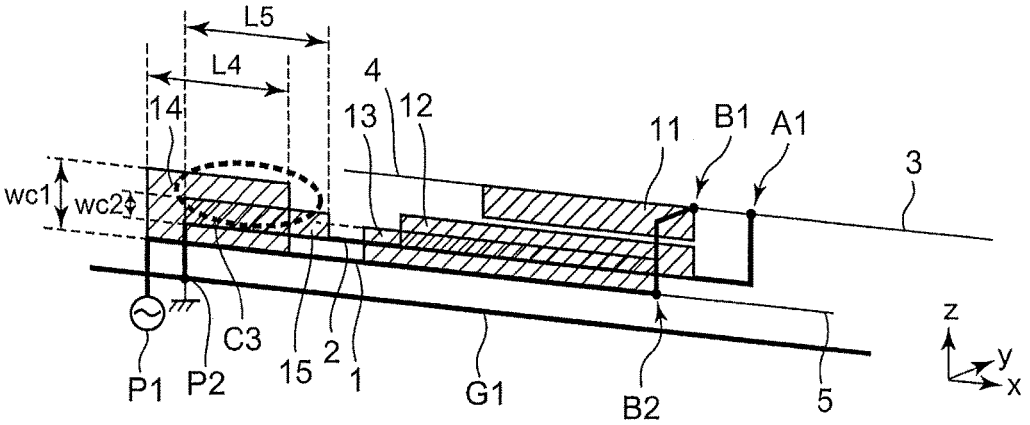
FIG. 16 is a perspective view showing an outline of an antenna apparatus according to a fourth modified embodiment of the first embodiment.

FIG. 16 is a perspective view showing an outline of an antenna apparatus according to a fourth modified embodiment of the first embodiment. The antenna apparatus of FIG. 16 is configured in a manner similar to that of the antenna apparatus of FIG. 15, and further provided with a plurality of coupling elements 12 and 15 integrally formed with base radiation element 2, and a plurality of coupling elements 13 and 14 integrally formed with base radiation element 1, at a plurality of positions of portions where the base radiation elements 1 and 2 are close to each other. A capacitive coupling C2 occurs between the coupling elements 12 and 13, and a capacitive coupling C3 occurs between the coupling elements 14 and 15. Referring to FIG. 16, the coupling element 14 has a length "L4" in the "x" direction, and a width "wc1" in the "z" direction, and is provided in the "+z" direction relative to the base radiation element 1. The coupling element 15 has a length "L5" in the "x" direction, and a width "wc2" in the "z" direction, and is provided in the "+z" direction relative to the base radiation element 2. The coupling elements 14 and 15 are close to each other at a distance "d1", and thus, the coupling elements 14 and 15 are capacitively coupled to each other. Any of the plurality of coupling elements 12 to 15 may have different dimensions from other coupling elements to adjust the radiation impedance of the antenna apparatus. For example, the coupling element 14 provided close to a feed point P1 may have a larger width "wc1" in the "z" direction than the other coupling elements.

[2-1-3. Antenna Apparatus with Additional Capacitive Couplings (3)]

Figure 17:
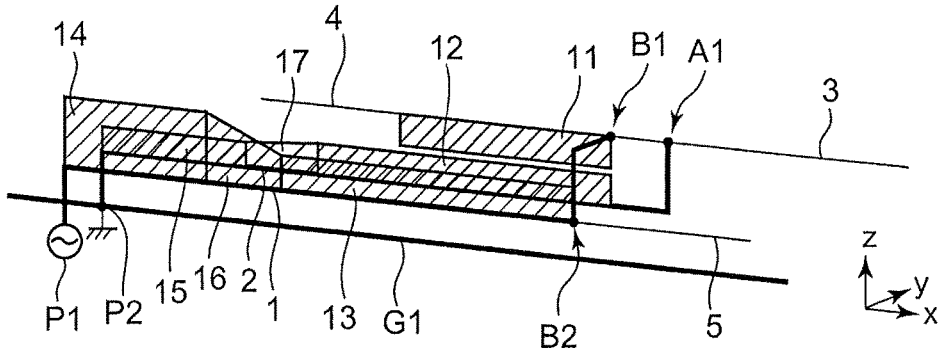
FIG. 17 is a perspective view showing an outline of an antenna apparatus according to a fifth modified embodiment of the first embodiment.

FIG. 17 is a perspective view showing an outline of an antenna apparatus according to a fifth modified embodiment of the first embodiment. The antenna apparatus of FIG. 17 is configured in a manner similar to that of the antenna apparatus of FIG. 16, and further provided with a coupling element 16 between coupling elements 12 and 15, having a width continuously changing in the "z" direction, and provided with a coupling element 17 between coupling elements 13 and 14, having a width continuously changing in the "z" direction. Thus, when two adjacent coupling elements among the plurality of coupling elements integrally formed with a base radiation element 1 or 2 have different widths in a direction orthogonal to the first direction, the antenna apparatus is further provided with a coupling element between the two adjacent coupling elements, having a width continuously changing in the direction orthogonal to the first direction.

[2-1-4. Antenna Apparatus with Additional Capacitive Couplings (4)]

Figure 18:
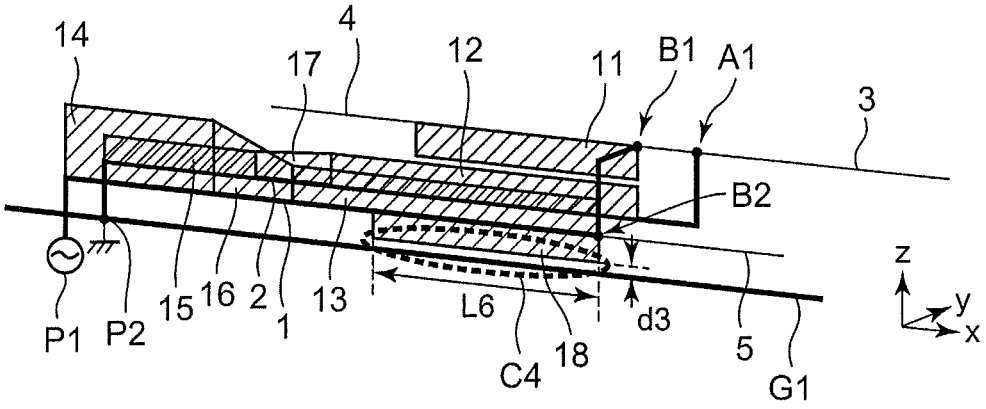
FIG. 18 is a perspective view showing an outline of an antenna apparatus according to a sixth modified embodiment of the first embodiment.

FIG. 18 is a perspective view showing an outline of an antenna apparatus according to a sixth modified embodiment of the first embodiment. The antenna apparatus of FIG. 18 is further provided with a ground conductor G1, and a fifth coupling element 18 integrally formed with a base radiation element 1. A capacitive coupling C4 occurs between the coupling element 18 and the ground conductor G1. Referring to FIG. 18, the coupling element 18 has a length "L6" in the "x" direction, and a width in the "z" direction, and is provided in the "−z" direction relative to the base radiation element 1. The coupling element 18 and the ground conductor G1 are close to each other at a distance "d5", and thus, the coupling element 18 and the ground conductor G1 are capacitively coupled to each other.

2-2. Specific Implementations of Antenna Apparatuses with Additional Capacitive Couplings Next, with reference to FIGS. 19 to 21, specific implementations of antenna apparatuses having additional capacitive couplings will be described.

[2-2-1. Antenna Apparatus of Fifth Implementation Example]

Figure 19:
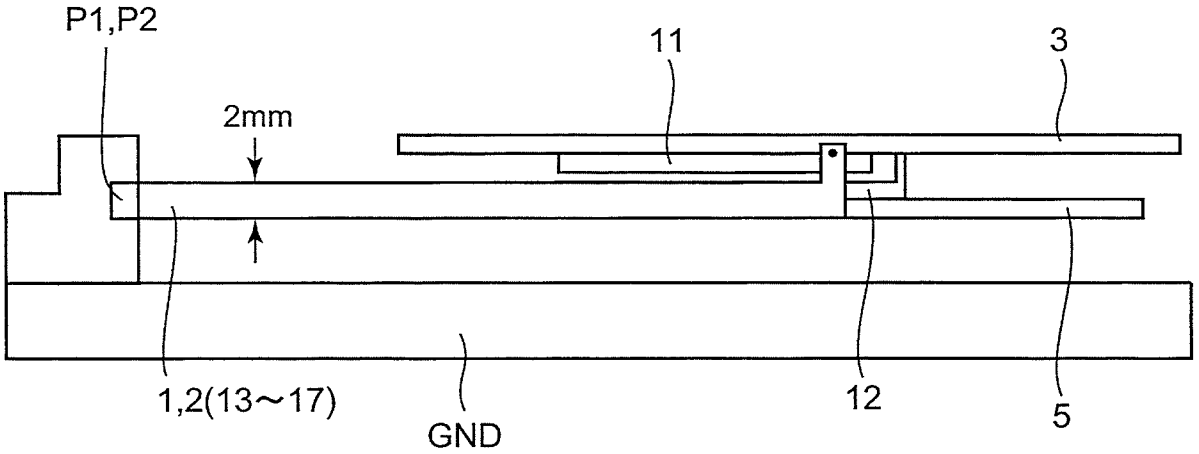
FIG. 19 is a diagram showing a configuration of an antenna apparatus according to a fifth implementation example of the first embodiment.

FIG. 19 is a diagram showing a configuration of an antenna apparatus according to a fifth implementation example of the first embodiment. The antenna apparatus of FIG. 19 shows an example of a specific implementation of the antenna apparatus of FIG. 15 (the antenna apparatus with additional capacitive couplings (1)). In the antenna apparatus according to the fifth implementation example, the width of base radiation elements 1 and 2 is increased over the third implementation example. The entire base radiation elements 1 and 2 of FIG. 19 are capacitively coupled to each other. Therefore, the antenna apparatus of FIG. 19 substantially includes coupling elements 12 to 17, and thus, can also be regarded to be a specific implementation of the antenna apparatus of FIG. 17 (the antenna apparatus with additional capacitive couplings (3)).

[2-2-2. Antenna Apparatus of Sixth Implementation Example]

Figure 20:
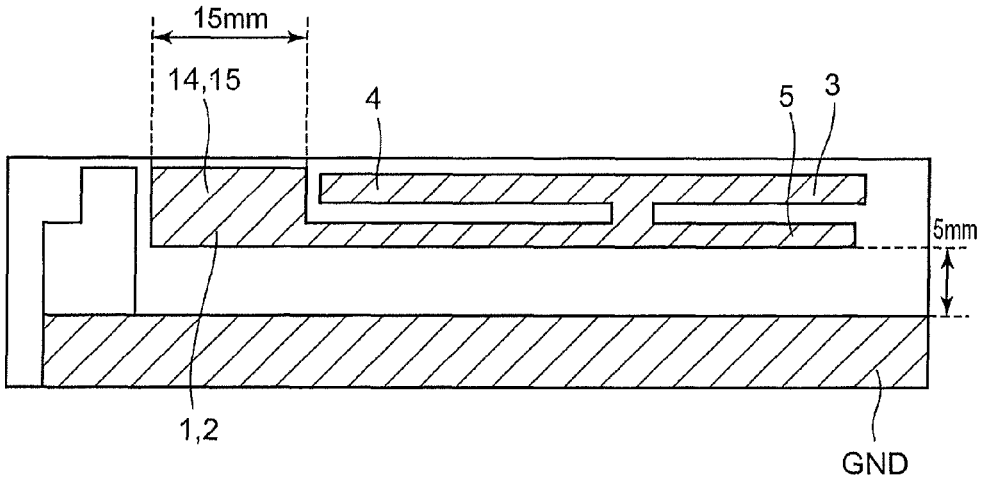
FIG. 20 is a diagram showing a configuration of an antenna apparatus according to a sixth implementation example of the first embodiment.

FIG. 20 is a diagram showing a configuration of an antenna apparatus according to a sixth implementation example of the first embodiment. The antenna apparatus of FIG. 20 shows an example of a specific implementation of the antenna apparatus of FIG. 16 (the antenna apparatus with additional capacitive couplings (2)). The antenna apparatus of FIG. 20 is of an exemplary case in which the antenna apparatus of FIG. 16 is configured as conductive patterns formed on both sides of a dielectric substrate.

[2-2-3. Antenna Apparatus of Seventh Implementation Example]

Figure 21:
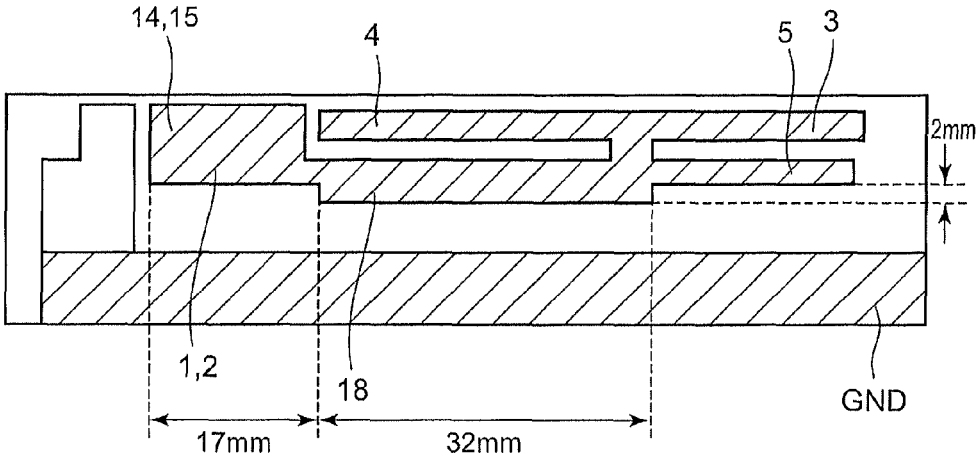
FIG. 21 is a diagram showing a configuration of an antenna apparatus according to a seventh implementation example of the first embodiment.

FIG. 21 is a diagram showing a configuration of an antenna apparatus according to a seventh implementation example of the first embodiment. The antenna apparatus of FIG. 21 is of an exemplary case in which the antenna apparatus of FIG. 18 is configured as conductive patterns formed on both sides of a dielectric substrate. A coupling element 18 is integrally formed, and extends in the "−x" direction from a branch point B2. The coupling element 18 has a length L6=32 mm. The coupling element 18 and the ground conductor G1 are close to each other at a distance d3=5.5 mm. The length "L6" and the distance "d3" affect the operation of the antenna apparatus mainly at the low-band frequency F1.

[2-2-4, Antenna Apparatus of Eighth Implementation Example]

Figure 24:
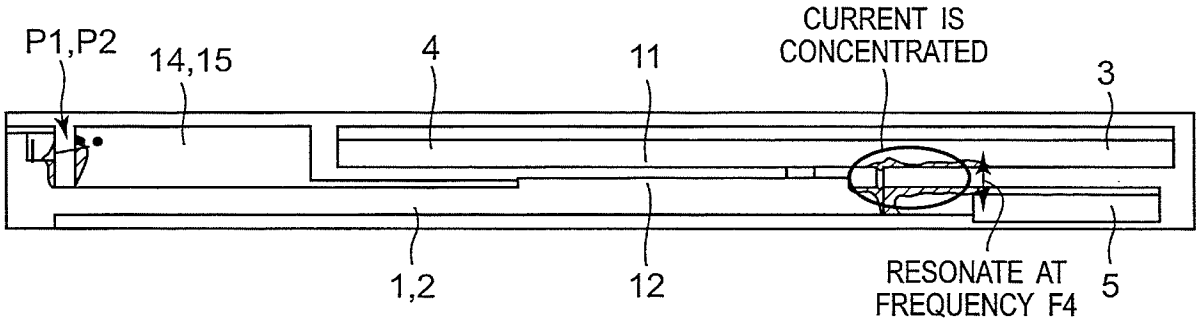
FIG. 24 is a diagram showing a current distribution observed when an antenna apparatus according to an eighth implementation example of the first embodiment operates at a second high-band frequency F4 (2600 MHz)

In addition, the antenna apparatuses of FIGS. 15 to 18 may be configured as conductive patterns formed on both sides of a dielectric substrate (a printed circuit board or flexible circuit board). An antenna apparatus of FIG. 24 is of an exemplary case in which the antenna apparatus of FIG. 16 is configured as conductive patterns formed on both sides of a dielectric substrate. In FIG. 24, crosshatched areas on radiation elements indicate portions where strong currents flow, and white areas on radiation elements indicate portions where weak currents flow.

2-3. Advantageous Effects of Antenna Apparatuses with Additional Capacitive Couplings With reference to FIGS. 22 and 23, the advantageous effects of the antenna apparatuses having the additional capacitive couplings will be described below.

[2-3-1. Characteristics of Antenna Apparatus of Fifth Implementation Example]

Figure 22:
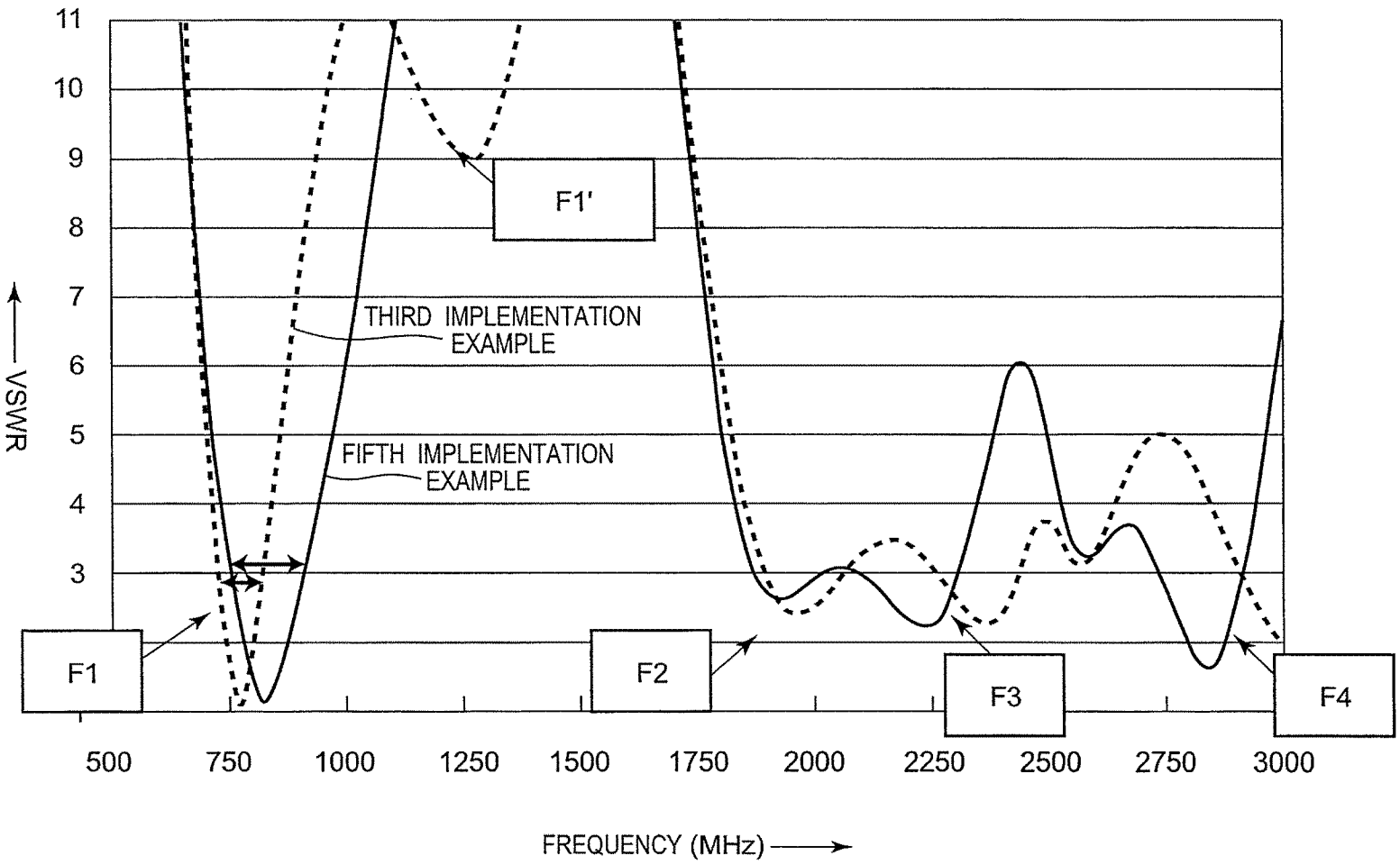
FIG. 22 is a graph showing the VSWR versus frequency characteristics of the antenna apparatuses according to the third and fifth implementation examples.

FIG. 22 is a graph showing the VSWR versus frequency characteristics of the antenna apparatuses according to the third and fifth implementation examples. It is possible to adjust the capacitive coupling by adjusting the areas of portions where the coupling elements 12 to 17 oppose to each other, and thus, it is possible to adjust the radiation impedance of the low-band frequencies F1 and F1'. As a result, it is possible to increase the bandwidths of bands including the low-band frequencies F1 and F1' (e.g., 800 MHz band). According to FIG. 22, when VSWR=3, while the fractional bandwidth of the third implementation example is 15.0%, the fractional bandwidth of the fifth implementation example is increased to 19.2%. When affecting the radiation impedance mainly of the low-band frequency F1, the coupling elements 14 and 15 close to the feed point P1 affect the radiation impedance differently from the coupling elements 12 and 13 close to the branch point B1 (i.e., a portion where a current is concentrated). Accordingly, it is possible to increase the bandwidth by adjusting the lengths or areas of these coupling elements.

In addition, the coupling elements 14 and 15 affect not only the bands including the low-band frequencies F1 and F1' (e.g., 800 MHz band), but also a band including a high-band frequency near a 3 GHz band. Referring to FIG. 22, although the antenna apparatus according to the third implementation example also resonates at another high-band frequency, 3 GHz, the antenna apparatus according to the fifth implementation example resonates in a band including a frequency F4=2.7 GHz reduced due to the coupling elements 14 and 15. Therefore, the antenna apparatus according to the fifth implementation example can achieve multiband operation in bands including frequencies F1, F2, F3, and F4. When the antenna apparatus operates at the high-band frequency F4 as shown in FIG. 22, the high-band frequency F4 can be adjusted by the branch radiation element 5, and also adjusted by a capacitive coupling C5 which is formed between the branch radiation elements 3 and 5 provided close to each other, and which will be described later with reference to FIG. 25.

[2-3-2. Characteristics of Antenna Apparatuses of Sixth and Seventh Implementation Examples]

Figure 23:
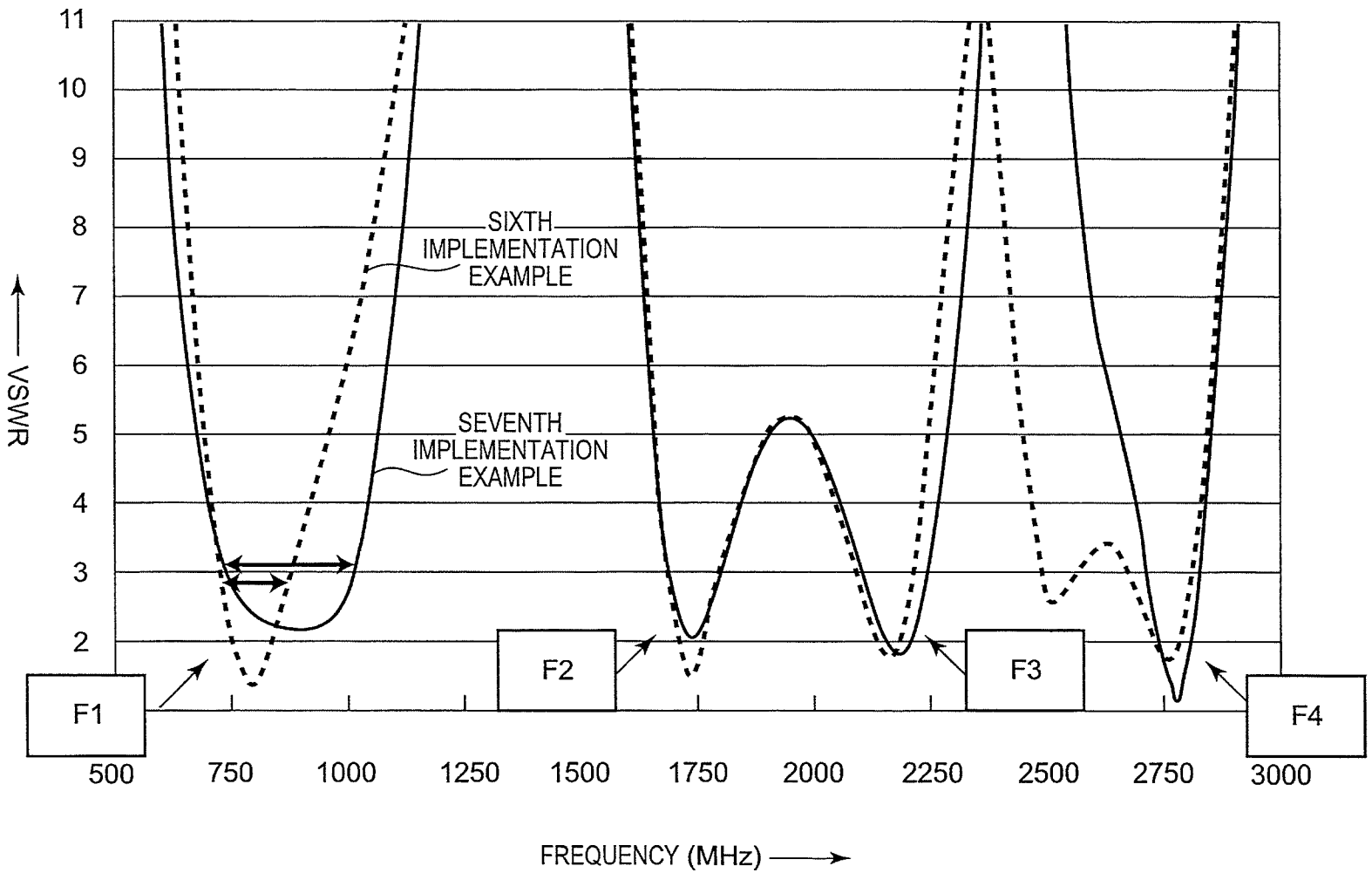
FIG. 23 is a graph showing the VSWR versus frequency characteristics of the antenna apparatuses according to the sixth and seventh implementation examples.

FIG. 23 is a graph showing the VSWR versus frequency characteristics of the antenna apparatuses according to the sixth and seventh implementation examples. It is possible to reduce the Q-factor of the antenna apparatus mainly of the low-band frequency F1, by adjusting the length "L6" and the distance "d3" to adjust the capacitive coupling C4. According to FIG. 23, when VSWR=3, while the fractional bandwidth of the sixth implementation example is 19.8%, the fractional bandwidth of the seventh implementation example is increased to 30.7%. Thus, it can be seen that the antenna apparatus of FIG. 21 can achieve wide band operation in a band including the low-band frequency F1. An antenna apparatus of FIG. 29 can also obtain the same characteristics as that of the antenna apparatus of FIG. 21.

[2-3-3. Characteristics of Antenna Apparatus of Eighth Implementation Example]

FIG. 24 is a diagram showing a current distribution observed when the antenna apparatus according to an eighth implementation example of the first embodiment operates at a second high-band frequency F4 (2600 MHz). As shown in FIG. 24, when the antenna apparatus operates at the high-band frequency F4, a current is concentrated near a connection point A1, a capacitive coupling occurs between the branch radiation elements 3 and 5, a loop structure is formed by the capacitive coupling and the branch radiation elements 3 and 5, and the loop structure resonates.

As shown in FIG. 24, the coupling elements 11 and 12 have a length over a part (e.g., about ⅔) of the entire length of the branch radiation element 4 from the branch point B1. As described above, a current is concentrated at a position of the branch radiation element 4 close to the branch point B1, and on the other hand, a magnetic field dominate over an electric field at an end of the branch radiation element 4 remote from the branch point B1.

As shown in FIG. 24, the antenna apparatus of FIG. 16 can perform multiband operation in bands including the frequencies F1, F2, F3, and F4.

2-4. Additional Remarks of the Antenna Apparatuses with Additional Capacitive Couplings As described above, the antenna apparatuses having the additional capacitive couplings according to the first embodiment can achieve both multiband operation and wide band operation, while having a small size.

3-1. Outlines of Antenna Apparatuses Having Additional Micro Loop

Next, with reference to FIGS. 25 to 29, modified embodiments in which an antenna apparatus is provided with an additional micro loop will be described. In these modified embodiments, an additional micro loop is formed by two branch radiation elements whose tips are provided close to each other.

[3-1-1. Antenna Apparatus with Additional Micro Loop (1)]

Figure 25:
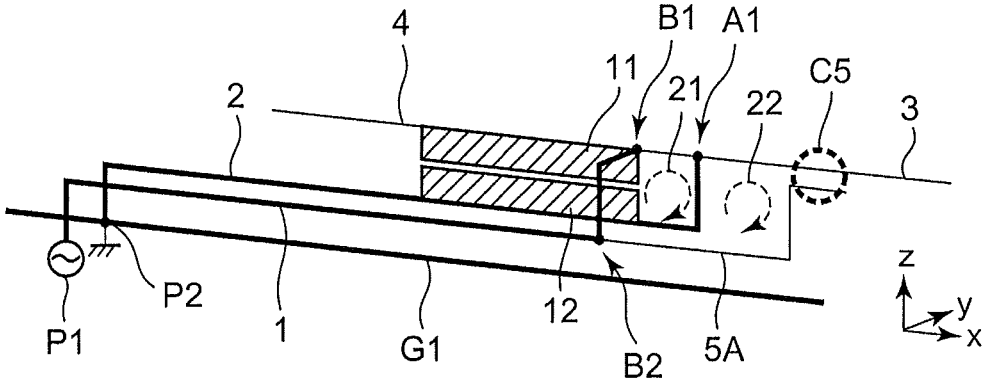
FIG. 25 is a perspective view showing an outline of an antenna apparatus according to a seventh modified embodiment of the first embodiment.

FIG. 25 is a perspective view showing an outline of an antenna apparatus according to a seventh modified embodiment of the first embodiment. The antenna apparatus of FIG. 25 is provided with a branch radiation element 5A, instead of a branch radiation element 5 of the antenna apparatus of FIG. 3. A capacitive coupling C5 occurs in parts of the branch radiation elements 3 and 5A. A micro loop 22 is formed of the branch radiation elements 3 and 5A, and a portion of a base radiation element 2 close to a connecting point A1. As described above, when the antenna apparatus operates at the high-band frequency F4 as shown in FIG. 22, the high-band frequency F4 can be adjusted by the capacitive coupling C5 formed between the branch radiation elements 3 and 5A provided close to each other.

[3-1-2. Antenna Apparatus with Additional Micro Loop (2)]

Figure 26:
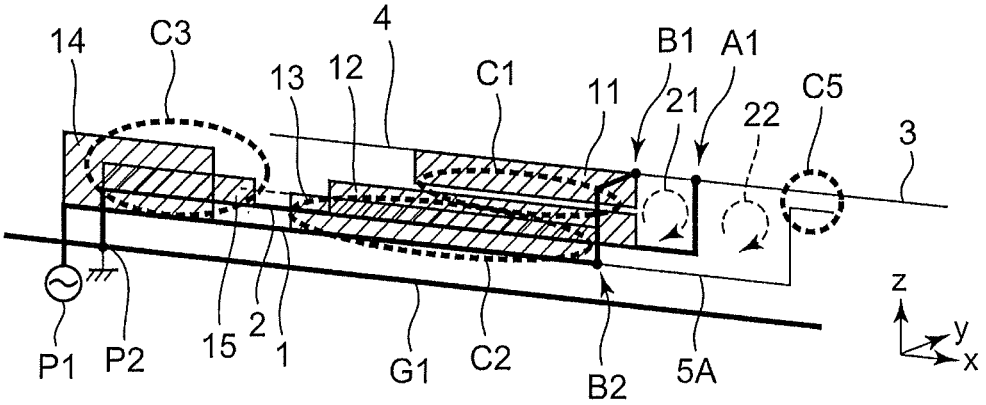
FIG. 26 is a perspective view showing an outline of an antenna apparatus according to an eighth modified embodiment of the first embodiment.
Figure 27:
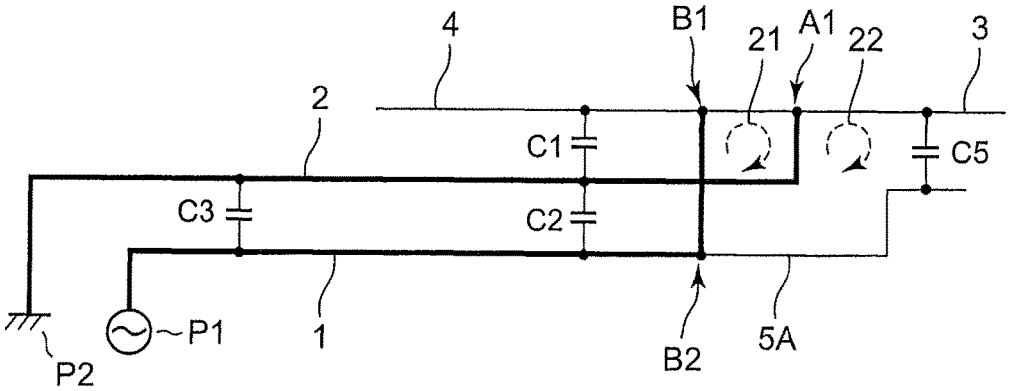
FIG. 27 is a diagram showing an equivalent circuit of the antenna apparatus of FIG. 26.

FIG. 26 is a perspective view showing an outline of an antenna apparatus according to an eighth modified embodiment of the first embodiment. The antenna apparatus of FIG. 26 is a combination of the antenna apparatuses of FIGS. 16 and 25. FIG. 27 is a diagram showing an equivalent circuit of the antenna apparatus of FIG. 26. The antenna apparatus can achieve desired multiband operation and wide band operation, by adjusting the lengths of branch radiation elements 3, 4, and 5A, and/or adjusting the capacitive couplings C1 to C3 and C5.

[3-1-3. Antenna Apparatus with Additional Micro Loop (3)]

Figure 28:
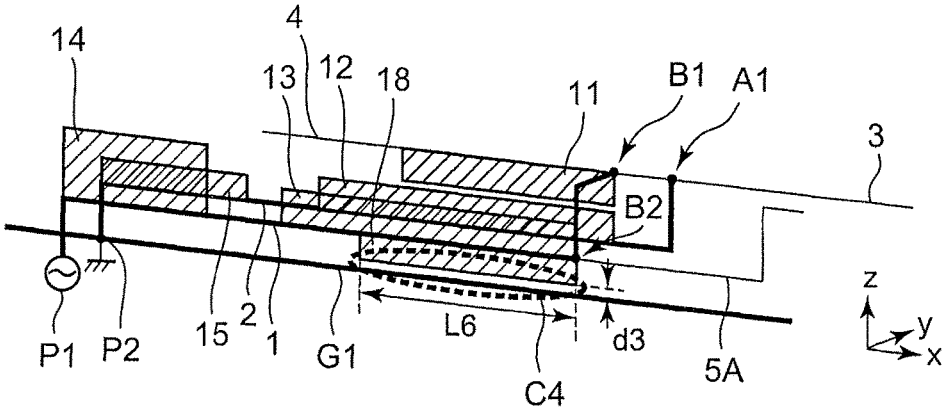
FIG. 28 is a perspective view showing an outline of an antenna apparatus according to a ninth modified embodiment of the first embodiment.

FIG. 28 is a perspective view showing an outline of an antenna apparatus according to a ninth modified embodiment of the first embodiment. The antenna apparatus of FIG.

28 is a combination of a coupling element 18 of FIG. 18 and the antenna apparatus of FIG. 26. The coupling element 18 and a ground conductor G1 are close to each other at a distance "d5", and thus, the coupling element 18 and the ground conductor G1 are capacitively coupled to each other.

[3-1-4. Antenna Apparatus with Additional Micro Loop (4)]

Figure 29:
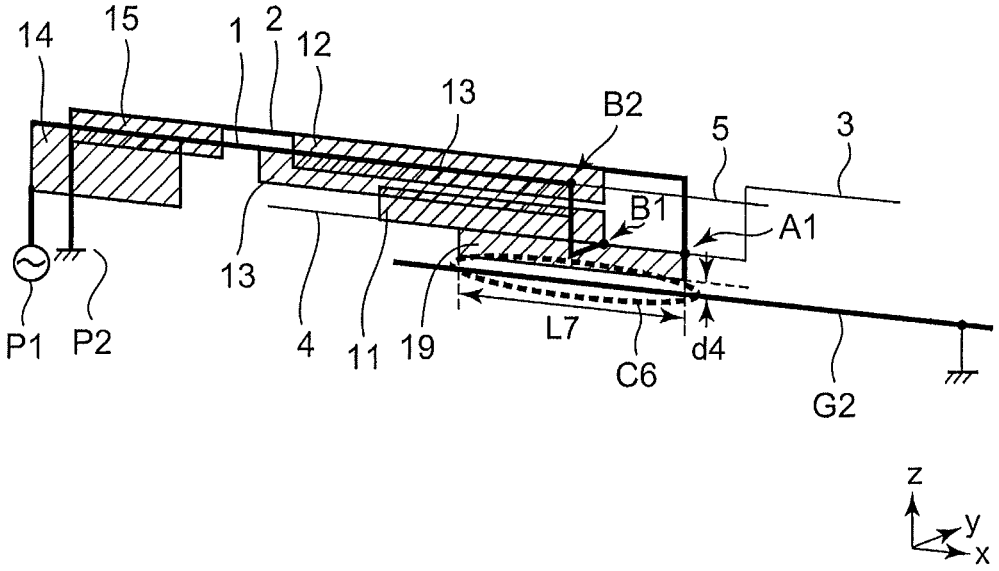
FIG. 29 is a perspective view showing an outline of an antenna apparatus according to a tenth modified embodiment of the first embodiment.

FIG. 29 is a perspective view showing an outline of an antenna apparatus according to a tenth modified embodiment of the first embodiment. The antenna apparatus is further provided with a ground conductor G2, and a sixth coupling element 19 integrally formed with at least one of branch radiation elements 3 and 4. A capacitive coupling C6 occurs between the coupling element 19 and the ground conductor G2. Referring to FIG. 29, the coupling element 19 has a length "L7" in the "x" direction, and a width in the "z" direction, and is provided in the "−z" direction relative to the branch radiation element 4. The coupling element 19 and the ground conductor G2 are close to each other at a distance "d4", and thus, the coupling element 19 and the ground conductor G2 are capacitively coupled to each other.

Since the antenna apparatuses of FIGS. 28 and 29 is provided with the additional coupling elements 18 and 19, the Q-factor of the antenna apparatuses can be reduced. In addition, the antenna apparatuses of FIGS. 28 and 29 can operate without a reduction in radiation impedance, even when a part of the base radiation elements 1 and 2 and branch radiation elements 3, 4, and 5A of the antenna apparatuses is provided close to the ground conductor G1 or G2.

In the antenna apparatuses of FIGS. 28 and 29, a capacitive coupling C4 or C6 may be formed using a coupling element integrally formed with the ground conductor G1 or G2.

3-2. Specific Implementations of Antenna Apparatuses Having Additional Micro Loop Next, with reference to FIGS. 30 to 32, specific implementations of antenna apparatuses having an additional micro loop will be described.

[3-2-1. Antenna Apparatus of Ninth Implementation Example]

Figure 30:
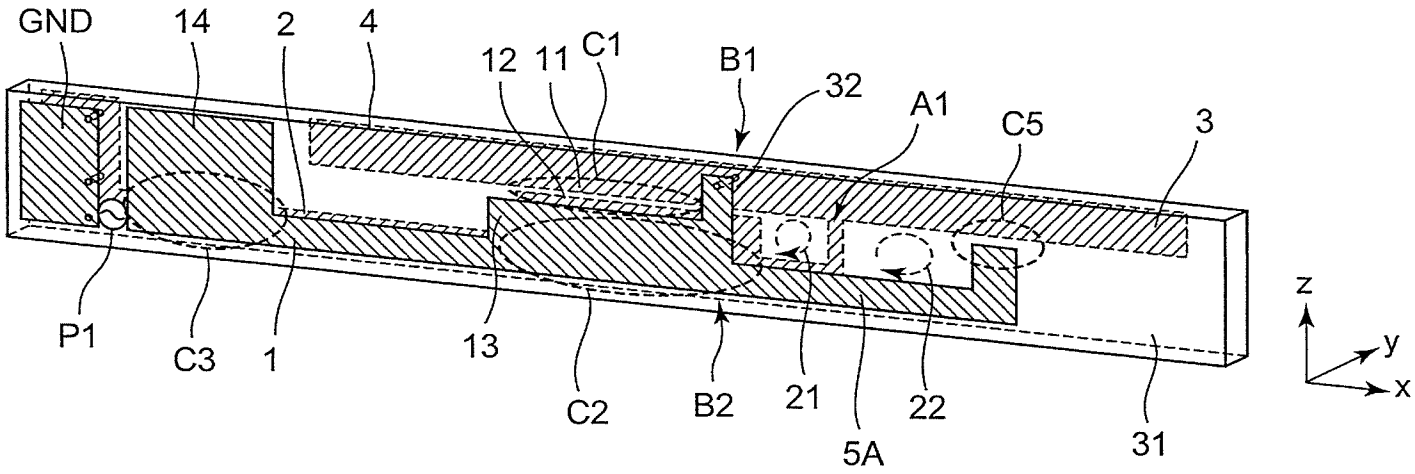
FIG. 30 is a diagram showing a configuration of an antenna apparatus according to a ninth implementation example of the first embodiment.

FIG. 30 is a diagram showing a configuration of an antenna apparatus according to a ninth implementation example of the first embodiment. The antenna apparatus of FIG. 30 shows an example of a specific implementation of the antenna apparatus of FIG. 26 (the antenna apparatus with additional micro loop (2)). The antenna apparatus of FIG. 30 is further provided with a dielectric substrate 31 having a first side (the front side, i.e., a "−y" side in FIG. 30) and a second side (the back side, i.e., a "+y" side in FIG. 30). A base radiation element 1 includes a portion formed on the first side, and a through-hole conductor 32 penetrating from the first side to the second side. A branch radiation element 5A and a coupling element 12 are formed on the first side. A base radiation element 2, branch radiation elements 3 and 4, and a coupling element 11 are formed on the second side. A branch point B1 is provided on the second side at the position of the through-hole conductor 32. The antenna apparatus of FIG. 30 may be further provided with coupling elements 13 to 17, capacitive couplings C1 to C3 and C5, a ground conductor GND, etc.

[3-2-2. Antenna Apparatus of Tenth Implementation Example]

Figure 31:
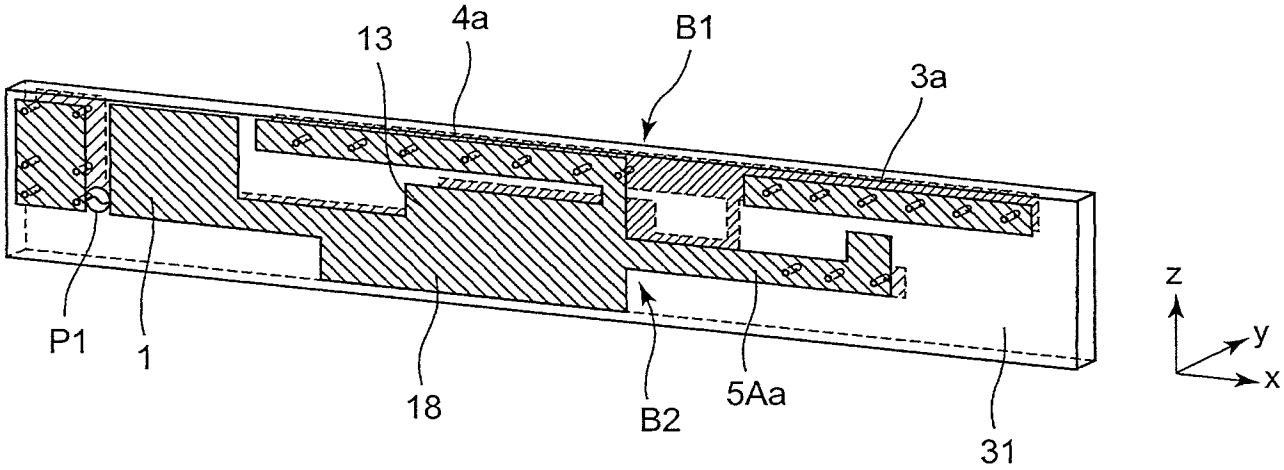
FIG. 31 is a diagram showing a configuration of an antenna apparatus according to a tenth implementation example of the first embodiment.
Figure 32:
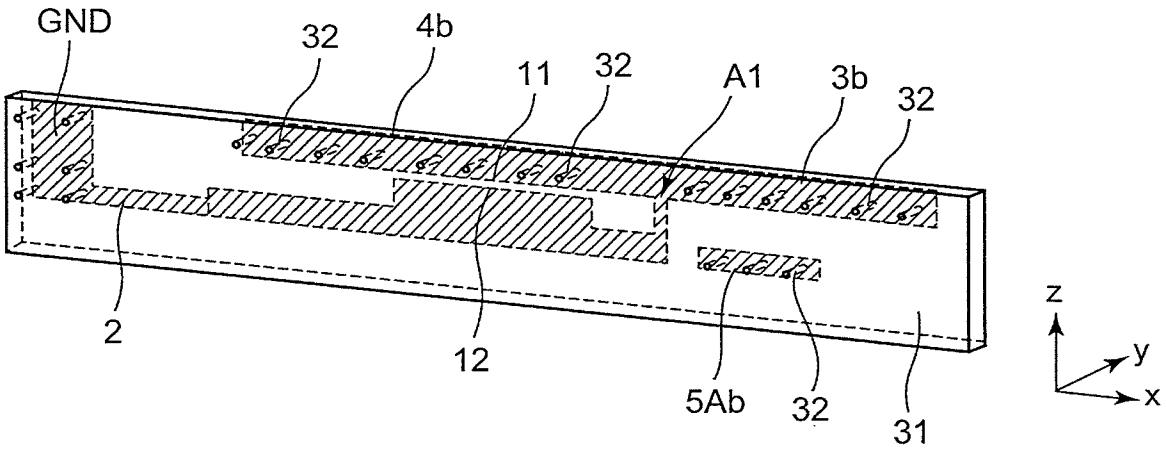
FIG. 32 is a diagram showing a configuration of the back side of the antenna apparatus of FIG. 31.

FIG. 31 is a diagram showing a configuration of an antenna apparatus according to a tenth implementation example of the first embodiment, FIG. 32 is a diagram showing a configuration of the back side of the antenna apparatus of FIG. 31. The antenna apparatus of FIGS. 31 and 32 shows an example of a specific implementation of the antenna apparatus of FIG. 28 (the antenna apparatus with additional micro loop (3)). The antenna apparatus of FIGS. 31 and 32 is further provided with a dielectric substrate 31 having a first side (the front side, i.e., a "−y" side in FIGS. 31 and 32) and a second side (the back side, i.e., a "+y" side in FIGS. 31 and 32). A base radiation element 1 is formed on the first side, and a base radiation element 2 and coupling elements 11 and 12 are formed on the second side. Branch radiation elements include portions 3*a*, 4*a*, and 5Aa formed on the first side, and portions 3*b*, 4*b*, and 5Ab formed on the second side. The portions 3*a*, 4*a*, and 5Aa formed on the first side, and the portions 3*b*, 4*b*, and 5Ab formed on the second side are connected to each other by a plurality of through-hole conductors 32 penetrating from the first side to the second side. Since the branch radiation elements are formed on both sides of the dielectric substrate 31, the areas of the respective branch radiation elements increase. Accordingly, the antenna apparatus can operate in a wide band at each of the frequencies F1, F2, and F3.

3-3. Additional Remarks of the Antenna Apparatuses Having Additional Micro Loop As described above, the antenna apparatuses having an additional micro loop according to the first embodiment can achieve both multiband operation and wide band operation, while having a small size.

4. Other Implementation Examples

4-1. Antenna Apparatus of Eleventh Implementation Example

Figure 33:
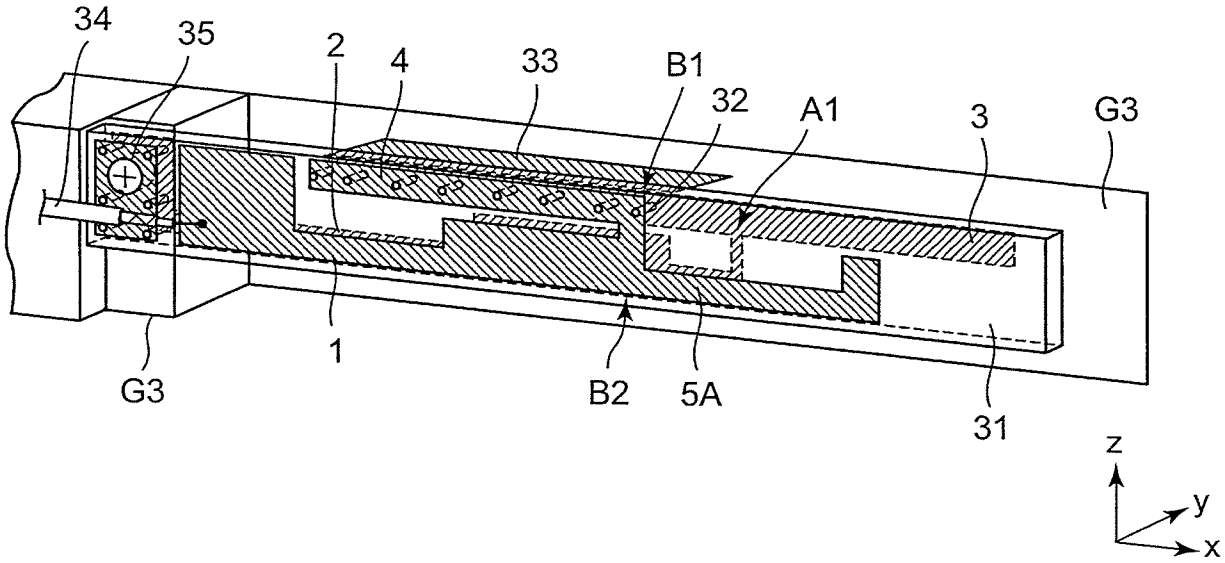
FIG. 33 is a diagram showing a configuration of an antenna apparatus according to an eleventh implementation example of the first embodiment.

FIG. 33 is a diagram showing a configuration of an antenna apparatus according to an eleventh implementation example of the first embodiment. The antenna apparatus of FIG. 33 is fed through a feed line 34, and is fixed to a ground conductor G3 using a screw 35. The antenna apparatus of FIG. 33 is further provided with a planar radiation element 33 perpendicular to a dielectric substrate 31, and electrically connected to at least one of branch radiation elements 3, 4, and 5A (in FIG. 33, the branch radiation element 4). Since the antenna apparatus of FIG. 33 is provided with the planar radiation element 33, the Q-factor of the antenna apparatus decreases, and thus, radiation efficiency improves.

4-2. Antenna Apparatus of Twelfth Implementation Example

Figure 34:
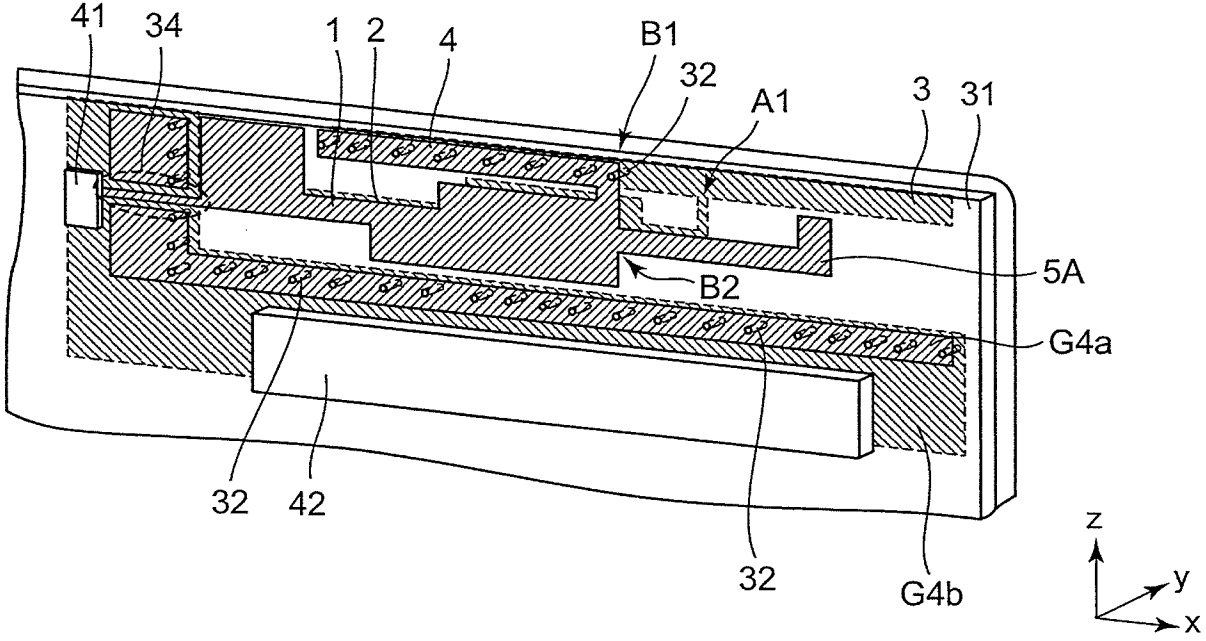
FIG. 34 is a diagram showing a configuration of an antenna apparatus according to a twelfth implementation example of the first embodiment.

FIG. 34 is a diagram showing a configuration of an antenna apparatus according to a twelfth implementation example of the first embodiment. The antenna apparatus of FIG. 34 is further provided with ground conductors G4a and G4b. A wireless communication circuit 41 and other circuits 42 are provided on the ground conductor G4b. The ground conductors G4a and G4b for the wireless communication circuit 41 and the other circuits 42 also serve as ground conductors for the antenna apparatus. The ground conductors G4a and G4b include a portion G4a formed on a first side, and a portion G4b formed on a second side. The portion G4a formed on the first side, and the portion G4b formed on the second side are connected to each other by a plurality of through-hole conductors 32 penetrating from the first side to the second side. Since the ground conductors G4a and G4b are connected by the plurality of through-hole conductors 32, the shielding effect of the ground conductors G4a and G4b is enhanced, thus reducing the influence of the wireless communication circuit 41 and the other circuits 42 exerted on the antenna apparatus.

Second Embodiment

The above described antenna apparatuses may be installed in wireless communication apparatuses such as mobile phones. In addition, the above described antenna apparatuses may be installed in electronic devices such as personal computers.

Figure 35:
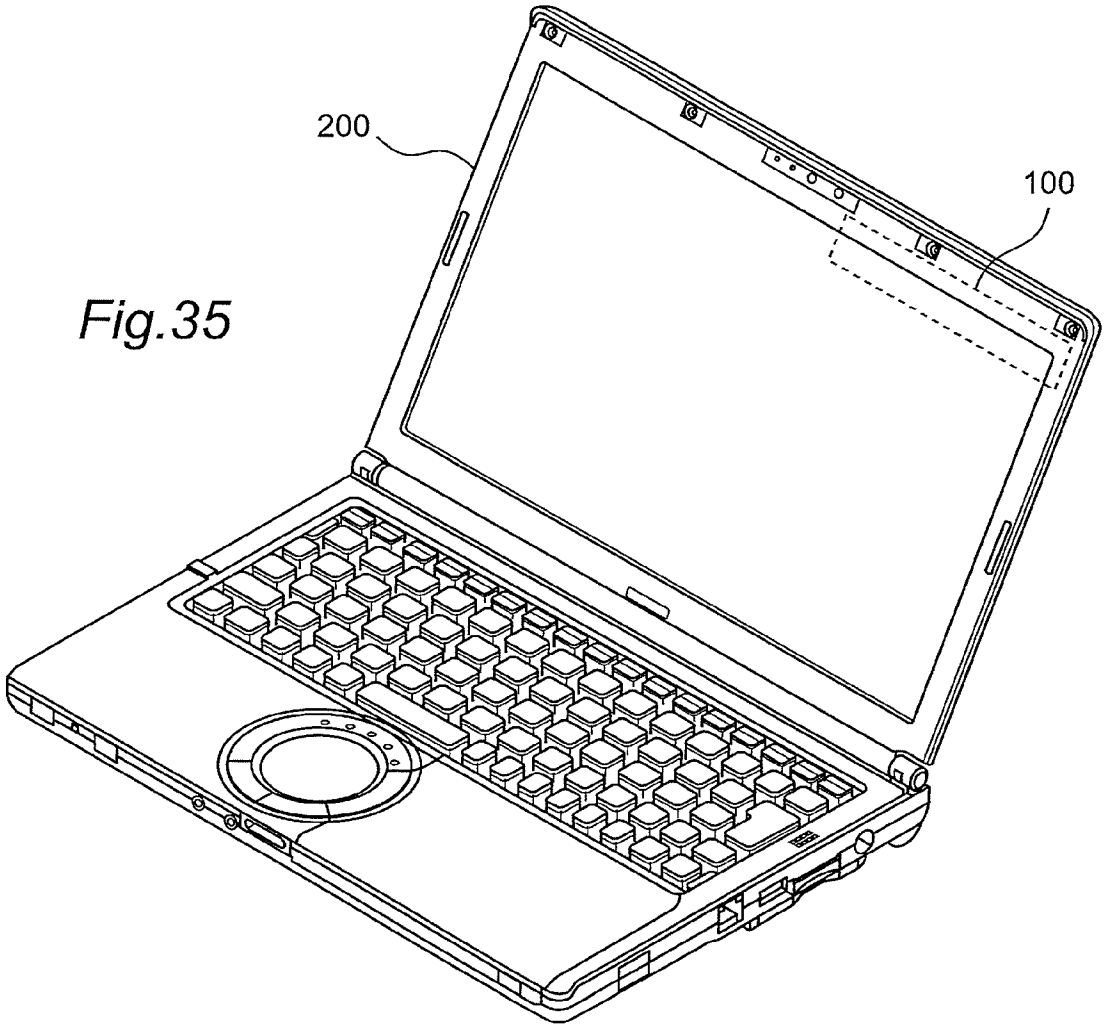
FIG. 35 is an opened perspective view showing a personal computer 200 according to a second embodiment.
Figure 36:
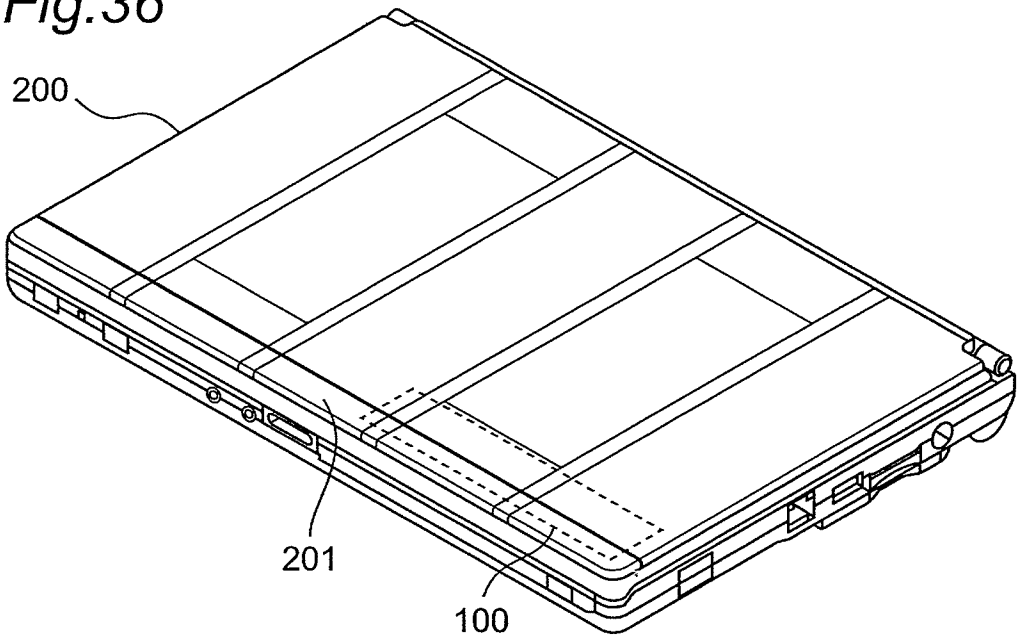
FIG. 36 is a closed perspective view showing the personal computer 200 of FIG. 35.

FIG. 35 is an opened perspective view showing a personal computer 200 according to a second embodiment. FIG. 36 is a closed perspective view showing the personal computer 200 of FIG. 35. The personal computer 200 of FIG. 35 is provided with an antenna apparatus 100 according to any of the above-described embodiments. As shown in FIG. 35, a portion close to the antenna apparatus 100 is configured by a resin housing portion 201, instead of a metal housing.

CONCLUSION

It is difficult to achieve multiband operation of the prior-art antenna apparatuses having a folded structure. In addition, there is a limit on reducing thickness and size of the prior-art antenna apparatus having a folded structure. On the other hand, according to the antenna apparatuses according to the embodiments of the present disclosure, base radiation elements 1 and 2 are formed so as to respectively include portions extending in a first direction and close to each other, and thus, the antenna apparatuses can achieve both reduced thickness and wide band operation. Due to this structure, the base radiation elements 1 and 2 and branch radiation elements 3, 4, and 5 can be formed as conductive patterns on a common dielectric substrate for a printed circuit board, such as FR4, and the thickness of the antenna apparatus can be reduced to, for example, 0.8 mm. In the case that the base radiation elements 1 and 2 and the branch radiation elements 3, 4, and 5 are formed on both sides of the dielectric substrate, a linear portion where a current with a desired frequency is concentrated is provided on one side, and a slit capacitive coupling C1 orthogonally intersecting the linear portion is provided on the other side. The antenna apparatuses according to the embodiments of the present disclosure can achieve wide band operation in a band including the low-band frequency F1 (704 to 960 MHz), and further operate in a band including the mid-band frequency F2 (1710 to 2170 MHz), and in a band including the high-band frequency F3 (2500 to 2700 MHz), and thus, can achieve multiband operation in which resonance frequencies in the respective bands are adjusted independently.

According to the antenna apparatuses according to the embodiments of the present disclosure, even when a part of the base radiation elements 1 and 2 and branch radiation elements 3, 4, and 5 of the antenna apparatuses is provided close to a ground conductor G1, radiation impedance can be adjusted by changing the shapes of the base radiation elements 1 and 2 and the branch radiation elements 3, 4, and 5. Thus, it is possible to provide antenna apparatuses operable in multiple and wide bands.

The antenna apparatuses according to the embodiments of the present disclosure can be manufactured using a printed circuit board. Accordingly, for example, an antenna apparatus can be integrated with a circuit board of a wireless communication apparatus in which the antenna apparatus is installed. Therefore, an antenna apparatus can be manufactured at low cost and with high accuracy. In addition, the durability of the antenna apparatus also improves.

As described above, the first and second embodiments are described as examples of the technique disclosed in the present application. However, the technique according to the present disclosure is not limited thereto, and can also be applied to other embodiments including appropriate changes, substitutions, additions, omissions, etc. In addition, a new embodiment may be made by combining the components described in the first and second embodiments.

As described above, the embodiments are described as examples of the technique according to the present disclosure. To this end, the detailed description and accompanying drawings are provided.

Therefore, the components described in the detailed description and accompanying drawings may include not only those components necessary to solve the problems, but also those components to exemplify the technique and not necessary to solve the problems. Hence, the unnecessary components should not be judged to be necessary just because the unnecessary components are described in the detailed description and accompanying drawings.

In addition, since the above-described embodiments are examples of the technique according to the present disclosure, it is possible to make various changes, substitutions, additions, omissions, etc., within the scope of the claims or their equivalency.

The present disclosure can be applied to a small antenna apparatus operable in multiple and wide bands, and it is possible to relatively easily reduce effects of metal parts and/or a housing around the antenna apparatus. The present disclosure can be applied to a small multiband antenna apparatus, for example, for LTE. The present disclosure can be applied to a wireless communication apparatus and an electronic apparatus provided with such an antenna apparatus, thus operable in multiple and wide bands, while having a small size.

The invention claimed is:

1. An antenna apparatus comprising:

a feed point;

a ground point;

a first base radiation element and a second base radiation element; and a connecting element, wherein the first base radiation element has a first end and a second end opposite to the first end, and extends between the first and second ends of the first base radiation element, the first end of the first base radiation element is connected to the feed point, and the first base radiation element includes a first portion extending in a +x direction, and a second portion including the second end of the first base radiation element, and the second portion extends in a +z direction and a +v direction continuously, wherein the second base radiation element has a third end and a fourth end opposite to the third end, and extends between the third and fourth ends of the second base radiation element, the third end of the second base radiation element is connected to the ground point, the second base radiation element includes a third portion extending in the +x direction, and a fourth portion including the fourth end of the second base radiation element, and the fourth portion extends in the +x direction and the +z direction continuously, wherein the first end of the first base radiation element is closer to the third end of the second base radiation element than to the fourth end of the second base radiation element, and the second end of the first base radiation element is closer to the fourth end of the second base radiation element than to the third end of the second base radiation element, wherein the first portions of the first base radiation element and the third portion of second base radiation element are parallel to each other and spaced at a predetermined distance from each other in the +y direction, wherein the connecting element has a fifth end and a sixth end opposite to the fifth end, and extends between the fifth and sixth ends of the connecting element, the fifth ends of the connecting element is connected directly to the second end of the first base radiation element, the sixth end of the connecting element is connected directly to the fourth end of the second base radiation element, and the connecting element extends in the +x direction, and wherein the second portion of the first base radiation element, the fourth portion of the second base radiation element and the connecting element constitute a loop configuration electrically, and the first and second base radiation elements are electrically connected to each other only through the connecting element.

2. The antenna apparatus as claimed in claim 1, further comprising:

a first branch radiation element and a second branch radiation element, wherein the first base radiation element is branched into the first and second branch radiation elements at a first branch point located at the second end of the first base radiation element, the first and second branch radiation element are open-ended, the first branch radiation element includes a portion extending in the first direction from the first branch point, and the second branch radiation element includes a portion extending in a second direction from the first branch point, and the second direction is opposite to the first direction, and wherein the connecting element is a part of the first branch radiation element.

3. The antenna apparatus as claimed in claim 2, wherein the first and second base radiation elements and the first branch radiation element resonate at a first frequency, and wherein the second branch radiation element resonates at a second frequency higher than the first frequency.

4. The antenna apparatus as claimed in claim 2, further comprising a third branch radiation element branched at a second branch point on the first base radiation element, wherein the third branch radiation element is open ended, and the third branch radiation element includes a portion extending in the first direction from the second branch point.

5. The antenna apparatus as claimed in claim 4, wherein the first and second base radiation elements and the first branch radiation element resonate at a first frequency, wherein the second branch radiation element resonates at a second frequency higher than the first frequency, and wherein the third branch radiation element resonates at a third frequency higher than the second frequency.

6. The antenna apparatus as claimed in claim 4, wherein parts of the respective first and third branch radiation elements are capacitively coupled to each other.

7. The antenna apparatus as claimed in claim 4, further comprising:

a first coupling element extending along the second branch radiation element and integrally formed with the second branch radiation element; and a second coupling element extending along the second base radiation element and integrally formed with the second base radiation element, wherein the first and second coupling elements are capacitively coupled to each other.

8. The antenna apparatus as claimed in claim 7, further comprising a third coupling element extending along the first base radiation element and integrally formed with the first base radiation element, wherein the third coupling element is capacitively coupled to at least one of the first and second coupling elements.

9. The antenna apparatus as claimed in claim 8, further comprising, at a plurality of positions of the respective first portions of the first and second base radiation elements:

a plurality of second coupling elements extending along the second base radiation element and integrally formed with the second base radiation element; and a plurality of third coupling elements extending along the first base radiation element and integrally formed with the first base radiation element, wherein the plurality of second coupling elements are capacitively coupled to the plurality of third coupling elements, respectively.

10. The antenna apparatus as claimed in claim 9, further comprising, in one of a first case that two adjacent second coupling elements among the plurality of second coupling elements have different widths in a direction orthogonal to the first direction, and a second case that two adjacent third coupling elements among the plurality of third coupling elements have different widths in the direction orthogonal to the first direction:

a fourth coupling element between the two adjacent second coupling elements or between the two adjacent third coupling elements, the fourth coupling element having a width continuously changing in the direction orthogonal to the first direction.

11. The antenna apparatus as claimed in claim 10, further comprising:

a ground conductor; and a fifth coupling element extending along the first base radiation element and integrally formed with the first base radiation element, wherein the fifth coupling element is capacitively coupled to the ground conductor.

12. The antenna apparatus as claimed in claim 10, further comprising:

a ground conductor; and a sixth coupling element extending along at least one of the first and second branch radiation elements and integrally formed with the at least one of the first and second branch radiation elements, wherein the sixth coupling element is capacitively coupled to the ground conductor.

13. The antenna apparatus as claimed in claim 7, further comprising:

a dielectric substrate having a first side and a second side, wherein the first base radiation element includes a portion formed on the first side; and a through-hole conductor penetrating from the first side to the second side, wherein the third branch radiation element and the second coupling element are formed on the first side, wherein the second base radiation element, the first and second branch radiation elements, and the first coupling element are formed on the second side, and wherein the first branch point is provided on the second side at a position of the through-hole conductor.

14. The antenna apparatus as claimed in claim 7, further comprising:

a dielectric substrate having a first side and a second side, wherein the first base radiation element is formed on the first side, wherein the second base radiation element and the first and second coupling elements are formed on the second side, and wherein each of the first, second, and third branch radiation elements includes a portion formed on the first side and a portion formed on the second side, and the portions formed on the first side are connected to the portions formed on the second side by a plurality of through-hole conductors penetrating from the first side to the second side.

15. The antenna apparatus as claimed in claim 13, further comprising a third coupling element formed on the first side, the third coupling element extending along the first base radiation element and integrally formed with the first base radiation element, wherein the third coupling element is capacitively coupled to at least one of the first and second coupling elements.

16. The antenna apparatus as claimed in claim 13, further comprising a planar radiation element provided perpendicular to the dielectric substrate, and electrically connected to at least one of the first, second, and third branch radiation elements.

17. The antenna apparatus as claimed in claim 13, further comprising a ground conductor, wherein the ground conductor includes a portion formed on the first side, and a portion formed on the second side, and the portion formed on the first side are connected to the portion formed on the second side by a plurality of through-hole conductors penetrating from the first side to the second side.

18. A wireless communication apparatus comprising an antenna apparatus, the antenna apparatus comprising:

a feed point;

a ground point;

a first base radiation element and a second base radiation element; and a connecting element, wherein the first base radiation element has a first end and a second end opposite to the first end, and extends between the first and second ends of the first base radiation element, the first end of the first base radiation element is connected to the feed point, and the first base radiation element includes a first portion extending in a +x direction, and a second portion including the second end of the first base radiation element, and the second portion extends in a +z direction and a +y direction continuously, wherein the second base radiation element has a third end and a fourth end opposite to the third end, and extends between the third and fourth ends of the second base radiation element, the third end of the second base radiation element is connected to the ground point, the second base radiation element includes a third portion extending in the +x direction, and a fourth portion including the fourth end of the second base radiation element, and the fourth portion extends in the +x direction and the +z direction continuously, wherein the first end of the first base radiation element is closer to the third end of the second base radiation element than to the fourth end of the second base radiation element, and the second end of the first base radiation element is closer to the fourth end of the second base radiation element than to the third end of the second base radiation element, wherein the first portions of the first base radiation element and the third portion of second base radiation element are parallel to each other and spaced at a predetermined distance from each other in the +y direction, wherein the connecting element has a fifth end and a sixth end opposite to the fifth end, and extends between the fifth and sixth ends of the connecting element, the fifth end of the connecting element is connected directly to the second end of the first base radiation elements, the sixth end of the connecting element is connected directly to the fourth end of the second base radiation element and the connecting element extends in the +x direction, and wherein the second portion of the first and second base radiation element, the fourth portion of the second base radiation element and the connecting element constitute a loop configuration electrically, and the first and second base radiation elements are electrically connected to each other only through the connecting element.

19. An electronic device comprising an antenna apparatus, the antenna apparatus comprising:

a feed point;

a ground point;

a first base radiation element and a second base radiation element; and a connecting element, wherein the first base radiation element has a first end and a second end opposite to the first end, and extends between the first and second ends of the first base radiation element, the first end of the first base radiation element is connected to the feed point, and the first base radiation element includes a first portion extending in a +x direction, and a second portion including the second end of the first base radiation element, and the second portion extends in a +z direction and a +y direction continuously, wherein the second base radiation element has a third end and a fourth end opposite to the third end, and extends between the third and fourth ends of the second base radiation element, the third end of the second base radiation element is connected to the ground point, the second base radiation element includes a third portion extending in the +x direction, and a fourth portion including the fourth end of the second base radiation element, and the fourth portion extends in the +x direction and the +z direction continuously, wherein the first end of the first base radiation element is closer to the third end of the second base radiation element than to the fourth end of the second base radiation element, and the second end of the first base radiation element is closer to the fourth end of the second base radiation element than to the third end of the second base radiation element, wherein the first portions of the first base radiation element and the third portion of second base radiation element are parallel to each other and spaced at a predetermined distance from each other in the +y direction, wherein the connecting element has a fifth end and a sixth end opposite to the fifth end, and extends between the fifth and sixth ends of the connecting element, the fifth end of the connecting element is connected directly to the second end of the first base radiation elements, the sixth end of the connecting element is connected directly to the fourth end of the second base radiation element and the connecting element extends in the +x direction, and wherein the second portion of the first and second base radiation element, the fourth portion of the second base radiation element and the connecting element constitute a loop configuration electrically, and the first and second base radiation elements are electrically connected to each other only through the connecting element.

* * * * *